US012729500B2

(12) United States Patent
Frost et al.

(10) Patent No.: US 12,729,500 B2
(45) Date of Patent: Sep. 8, 2026

(54) SPIDER-WEB INSPIRED GEOGRIDS

(71) Applicant: Georgia Tech Research Corporation, Atlanta, GA (US)

(72) Inventors: David Frost, Atlanta, GA (US); Candas Oner, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 54 days.

(21) Appl. No.: 18/676,122

(22) Filed: May 28, 2024

(65) Prior Publication Data

US 2024/0392527 A1 Nov. 28, 2024

Related U.S. Application Data

(60) Provisional application No. 63/469,138, filed on May 26, 2023.

(51) Int. Cl.
*E02D 17/20* (2006.01)

(52) U.S. Cl.
CPC .... *E02D 17/202* (2013.01); *E02D 2300/0006* (2013.01)

(58) Field of Classification Search
CPC ..... E02D 17/202; E02D 2300/0084; E02D 2300/0006; B29D 28/00; B29C 55/10
See application file for complete search history.

(56) References Cited

U.S. PATENT DOCUMENTS 3,616,154 A * 10/1971 Dow ..... B29D 28/00 264/210.7
2002/0069605 A1* 6/2002 Hong ..... E02D 29/0241 52/660
2009/0214821 A1* 8/2009 Walsh ..... B32B 5/028 428/131

(Continued)

FOREIGN PATENT DOCUMENTS

CN 116024851 * 4/2023
WO WO 2015101287 * 7/2015
WO WO-2015101287 A1 * 7/2015 ..... E04C 5/07

OTHER PUBLICATIONS

Foreign reference.*

(Continued)

*Primary Examiner* — Carib A Oquendo
(74) *Attorney, Agent, or Firm* — Meunier Carlin & Curfman LLC

(57) ABSTRACT

Exemplary geosynthetic apparatus, e.g., geogrid, and designs thereof are disclosed that are configured to restrict displacement of aggregate that mimics biostructures that optimized aperture size, aperture shape and aperture orientation to improve load distribution, improve durability, and/or improve performance in retaining aggregates and other geo materials. The exemplary geosynthetic apparatus as a product is configured as a unit cell in which the center of the unit cell has a primary structure that extend through the center to the edge of the unit cell or one or more intermediate radial position (also referred to as "radial transect boundar- (Continued)

ies") therebetween. In embodiments in which the primary structure extends to the transect boundaries through the center of the unit cell, the primary structure are referred to as "radial ribs."

19 Claims, 25 Drawing Sheets

(56) References Cited

U.S. PATENT DOCUMENTS

2021/0402676 A1* 12/2021 Curson ..... B29C 55/14

OTHER PUBLICATIONS

Hussein, M.G. and Meguid, M.A., 2016. A three-dimensional finite element approach for modeling biaxial geogrid with application to geogrid-reinforced soils. Geotextiles and Geomembranes 44(3) 295-307.

Abdollahi, M., Moghaddas Tafreshi, S.N. and Leshchinsky, B., 2019. Experimental-numerical assessment of geogrid-EPS systems for protecting buried utilities. Geosynthetic International 26(4) 333-353.

Miao, C., Jia, Y., Zhang, J. and Zhao, J., 2020. DEM simulation of the pullout behavior of geogrid-stabilized ballast with the optimization of the coordination between aperture size and particle diameter. Construction and Building Materials 255 Article ID: 119359.

Zhong, W., Liu, H., Wang, Q., Zhang, W., Li, Y., Ding, X. and Chen, L., 2021, Investigation of the penetration characteristics of snakeskin-inspired pile using DEM. Acta Geotechnica 16 1849-1865.

Feng, S.J. and Wang Y.Q., 2023. DEM simulation of geogrid-aggregate interface shear behavior: Optimization of the aperture ratio considering the initial interlocking states. Computers and Geotechnics 154 Article ID: 105182.

Ahlvin, R. G. and H. H. Ulery (1962). Tabulated values for determining the complete pattern of stresses, strains, and deflections beneath a uniform circular load on a homogeneous half space. 41st Annual Meeting of the Highway Research Board. Washington, DC.

Bendsøe, M.P., Sigmund, O. (2004). Topology design of truss structures. In: Topology Optimization. Springer, Berlin, Heidelberg. https://doi.org/10.1007/978-3-662-05086-6_4.

Eschenauer, H. A. and N. Olhoff (2001). "Topology optimization of continuum structures: A review." Applied Mechanics Reviews 54(4): 331-390.

Skuodis, S., Dirgeliene, N. and Medzvieckas, J., 2020. Using triaxial tests to determine the shearing strength of geogrid-reinforced sand. Studia Geotechnica et Mechanica. 42(4) 341-354.

Martinez, A., Dejong, J., Akin, I., Aleali, A., Arson, C., Atkinson, J., Bandini, P., Baser, T., Borela, R., Boulanger, R., Burrall, M., Chen, Y., Collins, C., Cortes, D., Dai, S., DeJong, T., Del Dottore, E., Dorgan, K., Fragaszy, R., . . . Zheng, J., 2022. Bio-inspired Geotechnical Engineering: Principles, current work, opportunities and challenges. Géotechnique 72(8) 687-705.

Stolpe, M. and K. Svanberg (2001). "An alternative interpolation scheme for minimum compliance topology optimization." Structural and Multidisciplinary Optimization 22(2): 116-124.

O'Hara, K. and Martinez, A., 2020. Monotonic and cyclic frictional resistance directionality in snakeskin-inspired surfaces and piles. Journal of Geotechnical and Geoenvironmental Engineering. 146(11).

* cited by examiner

Octagon

Decagon

Dodecagon

Icosagon 6 radials
12 transects 12 radials
12 transects 12 radials
12 transects
12 chords 6 radials
12 transects
12 chords

506'

508'

Top view of the mesh

Investigated geogrid region

Triangular geogrid InterAx-shaped geogrid Optimized SniderAx (a)

(b)

(c)

| Name | Triaxial PP (Tr) | Triaxial PLA (Tr_PLA) | Triaxial Wide (Tr_W) | Triaxial Thick (Tr_T) |
|---|---|---|---|---|
| Unit cell | | | | |

*FIG. 10A*

| Name | Hexagonal (Heg) | Negative Hexagonal (NegHeg) |
|---|---|---|
| Unit cell | | |

*FIG. 10B*

| Name | Extra Large Y PLA (Y80_PLA_exL) | Large Y PLA and Large Y (Y80_PLA_L, Y80_L) | Y PLA and Y PP (Y80_PLA, Y80) | Small Y PLA (Y80_PLA_small) |
|---|---|---|---|---|
| Unit cell | | | | |

*FIG. 10C*

SPIDER-WEB INSPIRED GEOGRIDS

RELATED APPLICATION

The U.S. application claims priority to, and the benefit of, U.S. Provisional Patent Application No. 63/469,138, filed May 26, 2023, which is incorporated by reference herein in its entirety.

STATEMENT REGARDING FEDERALLY SPONSORED RESEARCH OR DEVELOPMENT

This invention was made with government support under grant no. EEC-1449501 awarded by the National Science Foundation. The government has certain rights in the invention.

BACKGROUND

Geosynthetics are synthetic products (e.g., polymers) used to stabilize terrain in geotechnical and civil engineering for separation, reinforcement, filtration, and drainage. Among geosynthetics, geogrids are used for reinforcement applications and are capable of locking the earth materials in place and thereby augmenting the stability of the system. Geogrids also provide load distribution improvement and a tensioned membrane effect. Various factors that can influence the effectiveness of the geogrid include, for example, its material type, aperture size, and shape. However, existing systems have failed to explore a range of size, shape, and material implementations.

There is a benefit to improving the testing of geogrids and other geosynthetic materials.

SUMMARY

Exemplary geosynthetic apparatus, e.g., geogrid, and designs thereof are disclosed that are configured to restrict displacement of aggregate that mimics biostructures that optimize aperture size, aperture shape and aperture orientation to improve load distribution, improve durability, and/or improve performance in retaining aggregates and other geomaterials. A study was conducted that developed several design topologies that are validated via simulations.

The exemplary geosynthetic apparatus as a product is configured as a unit cell in which the center of the unit cell has a primary structure that extends through the center to the edge of the unit cell or one or more intermediate radial positions (also referred to as "radial transect boundaries") therebetween. In embodiments in which the primary structure extends to the transect boundaries through the center of the unit cell, the primary structure is referred to as "radial ribs."

The exemplary geosynthetic apparatus as a product may be configured as a unit cell having radial positions, as secondary structures, that correspond to a portion of the unit cell to form a "multi-cell" unit cell. The secondary structures can have apertures having orientations that are orthogonal in whole to the primary structure or surround the central region of the unit cell.

The exemplary geosynthetic apparatus as a product may be configured with multiple aperture patterns each formed in the geosynthetic structure with an elongated orientation that traverse between the primary structures parallel to one another in which one of the primary structure extend through the center of the unit cell.

In an aspect, a geogrid device is disclosed comprising a plurality of beam members arranged to restrict displacement of aggregate, the plurality of beam members forming a plurality of openings defined by a pattern, each of the patterns of the plurality of openings forming a structure having a center interconnection (point or geometric shape) to which multiple continuous ribs members and associated openings extend and connected by lateral members, wherein the plurality of openings form a plurality of apertures having a predefined ratio, and wherein the plurality of apertures comprises at least one of square-, rectangular-, deltoid-, triangular-, parallelogram-, and trapezoidal-shaped apertures.

In another aspect, a geogrid product is disclosed comprising a plurality of apertures having predefined different orientations.

In some embodiments, the plurality of beam members are arranged to form at least three continuous ribs (e.g., 3, 4, 5, 6, 7, 8, 9, 10, or more) that extend from the center interconnection to form a unit cell with a plurality of aperture sizes.

In some embodiments, the plurality of beam members are arranged to form at least three continuous ribs (e.g., 3, 4, 5, 6, 7, 8, 9, 10, or more) that extend from the center interconnection to form a unit cell with a plurality of aperture primary axis orientations.

In some embodiments, a plurality of unit cells, each having a plurality of apertures are aligned adjacent to one another to form a secondary structure form reflective of the unit cell aperture distribution.

In some embodiments, a plurality of unit cells, each having a plurality of apertures, are aligned adjacent to one another to form a secondary structure form reflective of the unit cell's primary axis orientation.

In some implementations, the pattern of grid lines in the unit cell mimics that of a spider web.

In some implementations, the pattern of grid lines in the unit cell mimics selected radial aspects of a spider web.

In some implementations, the pattern of grid lines in the unit cell mimics selected transect aspects of a spider web.

In some implementations, the pattern of grid lines in the unit cell mimics selected chord aspects of a spider web.

In another aspect, a geogrid is disclosed comprising a substantially planar layer of polymeric material having a pattern formed therein to provide lateral confinement of a geotechnical environment to restrict displacement of aggregates, wherein the pattern comprises a plurality of interlocking beam members to form a repeating set of polygonal unit cells each having at least 6 sides (e.g., at least a hexagonal), wherein the repeating set of polygonal unit cells has (i) a center and (ii) a plurality of repeating apertures formed in between the interlocking beam members, wherein each of the repeating set of polygonal unit cells has a center interconnection at the center to which multiple continuous ribs members and associated apertures extend and connect to lateral members defining radial transect boundaries.

In some embodiments, the plurality of apertures of each of the repeating set of polygonal unit cells have multiple predefined opening size distributions, including a first opening size, a second opening size, and a third opening size, wherein the first opening size has a first percentage distribution, the second opening size has a second percentage distribution, the third opening size has a third percentage distribution (e.g., wherein the first opening size is greater than the second opening size, and wherein the first percentage distribution is greater than the second percentage distribution).

In some embodiments, the plurality of repeating apertures has a range of primary axis orientations.

In some embodiments, the plurality of repeating apertures comprises at least one of square, rectangular, triangular-, parallelogram-, and trapezoidal-shaped apertures.

In some embodiments, the center interconnection includes at least six continuous ribs (e.g., 6, 7, 8, 9, 10 or more) that extend from the center of the repeating set of polygonal unit cells for a polygonal unit cell having at least 6 sides.

In some embodiments, the center interconnection includes a pre-defined number of continuous ribs that extends from the center of the repeating set of polygonal unit cells, wherein the pre-defined number of continuous ribs is equal to, or is a multiple of, a number of boundary sides of a repeating polygonal unit cell.

In some embodiments, the pre-defined number of continuous ribs is twice or thrice (2× or 3×) that of a number of the sides of the boundary of a repeating polygonal unit cell.

In some embodiments, each of the continuous ribs of the center interconnection extent to a corner or a side of the sides of the boundary of a repeating polygonal unit cell.

In some embodiments, the repeating set of polygonal unit cells having the plurality of repeating apertures are aligned adjacent to one another to form a secondary structure form.

In some embodiments, the repeating set of polygonal unit cells having the plurality of repeating apertures has a primary axis orientation for the apertures that are aligned adjacent to one another to form a secondary structure form.

In some embodiments, the pattern of the plurality of interlocking beam members has beam members extending from the radial transect boundaries to the sides of the boundary of a repeating polygonal unit cell (e.g., having a radial aspect mimicking that of a spider web).

In some embodiments, the geogrid is employed as a retaining structure used to separate different elevations of aggregate material.

In some embodiments, the aggregate structure comprises a pavement system.

In some embodiments, the aggregate structure comprises a building foundation system.

In some embodiments, the center interconnection includes a first continuous rib, a second continuous rib, and a third continuous rib that each extends from the center of the repeating set of polygonal unit cell, wherein the pattern includes a set of continuous ribs that are parallel of each of the first continuous rib, the second continuous rib, and the third continuous rib to define a set of triangular secondary structures, and wherein each of the set of triangular secondary structures are bisected by tertiary rib structures.

In some embodiments, the center interconnection includes a first continuous rib, a second continuous rib, and a third continuous rib that each extends from the center of the repeating set of polygonal unit cell, the center interconnection including a plurality of radial transect boundaries to define a plurality of radial apertures within the center interconnection.

In some embodiments, the pattern includes a portion (e.g., half) of the center interconnection repeated at regions between the radial transect boundaries and the sides of the boundary of a repeating polygonal unit cell.

In some embodiments, the center interconnection includes a first continuous rib, a second continuous rib, and a third continuous rib that each extends from the center of the repeating set of polygonal unit cells, wherein the pattern includes a set of beams forming the radial transect boundaries having a first shape, wherein sides of the boundary of a repeating polygonal unit cell has a second shape, wherein the first shape and the second shape are the same, wherein the first shape is rotated 30 degrees from the second shape.

Additional advantages will be set forth in part in the description which follows or may be learned by practice. The advantages will be realized and attained by means of the elements and combinations particularly pointed out in the appended claims. It is to be understood that both the foregoing general description and the following detailed description are exemplary and explanatory only and are not restrictive, as claimed.

BRIEF DESCRIPTION OF DRAWINGS

FIGS. 10A, 10B, and 10C show examples of geogrids fabricated in a study.

DETAILED DESCRIPTION

The details of one or more embodiments of the invention are set forth in the accompanying drawings and the description below. Other features, objects, and advantages of the invention will be apparent from the description and drawings and from the claims.

Throughout the description and claims of this specification, the word "comprise" and other forms of the word, such as "comprising" and "comprises," means including but not limited to, and is not intended to exclude, for example, other additives, components, integers, or steps.

To facilitate an understanding of the principles and features of various embodiments of the present invention, they are explained hereinafter with reference to their implementation in illustrative embodiments.

Example Spider-Web Inspired Geogrid

Figure 1:
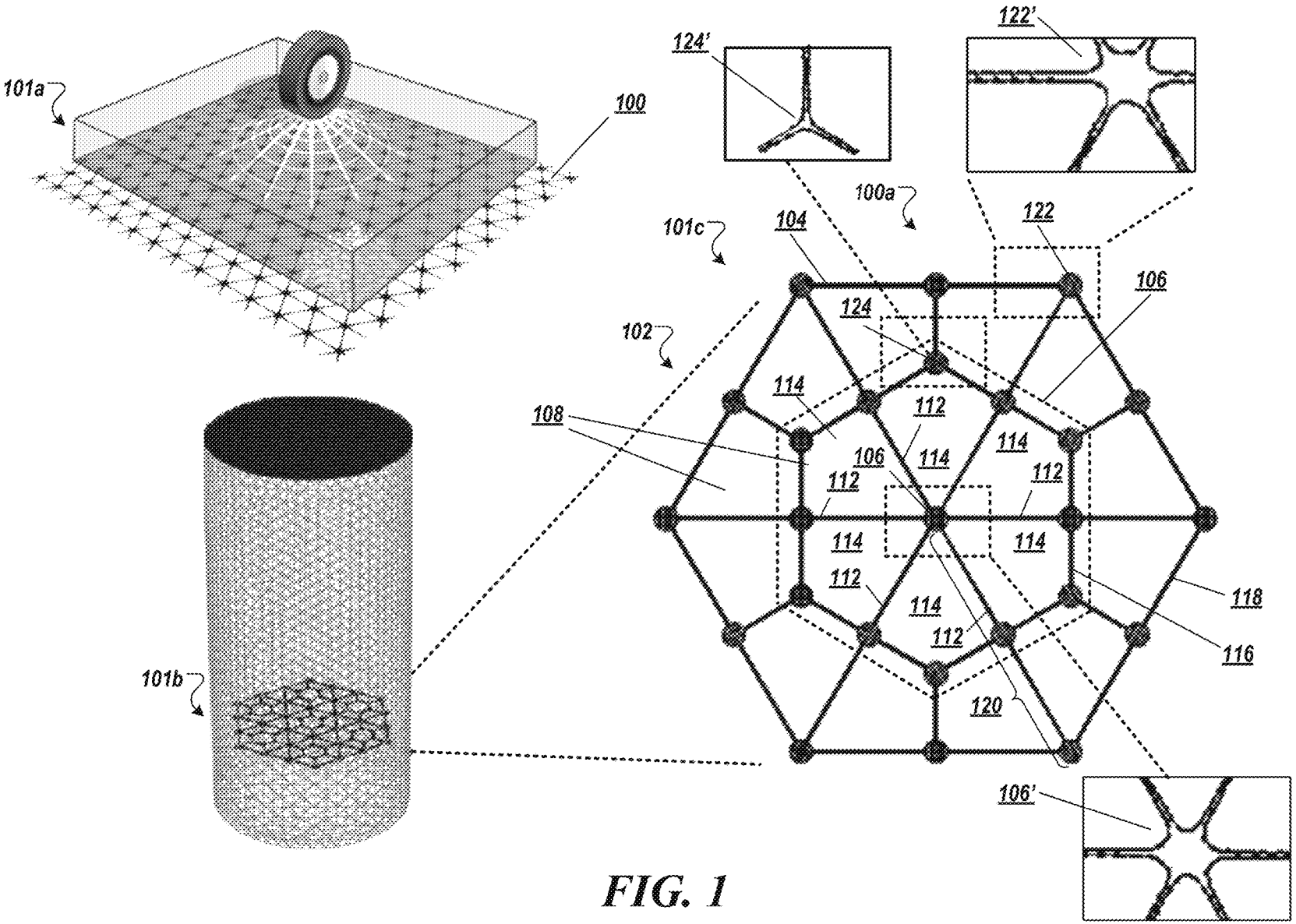
FIG. 1 shows an example geogrid having a geogrid pattern defined by a unit cell with center interconnections in accordance with an illustrative embodiment.

FIG. 1 shows an example geogrid 100 having a geogrid pattern 102 defined by a unit cell with center interconnections in accordance with an illustrative embodiment. FIG. 2A-2L shows example configurations of spider-web-inspired geogrid 100 (shown as 100*a*, 100*b*, 100*c*, 100*d*, 100*c*, 100*f*, 100*g*, 100*h*, 100*i*, 100*j*, 100*k*, 100*l*) having a center interconnection, e.g., as described in relation to FIG. 1, in accordance with an illustrative embodiment. The pattern of grid lines in the unit cell 102 mimics that of a spider web and is optimized for aperture size, aperture shape, and aperture orientation to improve load distribution, improve durability, and/or improve performance in retaining aggregates and other geomaterials.

Retaining Structures. In geotechnical engineering, grade separation refers to any elevation difference in the earth's materials. Retaining structures are used in the case when there is a grade separation in order to reinforce both the naturally occurring slopes or the slopes that are vulnerable to failure, usually due to human modification such as cuts or excavations under static (or dynamic) conditions. So as to satisfy the stability requirement of a retaining structure, static and dynamic forces that may arise from gravity, seismicity, wind, and pore water pressure should offset each other, or in other words, should be in equilibrium.

Geogrids are used in mechanically stabilized earth (MSE) wall designs. One of the roles of geogrids in these structures is to connect the zone that is not prone to failure to the facing of the wall. Earth materials fail in a zone called a failure zone, which depends on the strength properties of the soil. To mobilize the benefits of geogrids, which may be placed/installed horizontally, the geogrids can exceed the length of the failure zone. The geogrid installation can terminate within the stable zone. Geogrids also increase the shear strength of the soil by the resistance it has due to the friction and interlocking between the geogrid ribs and the soil. In a circumstance where there is a movement in the soil slope, this friction between the soil and the ribs of the geogrid will try to resist relative movement. Because of the effects of the geogrid mentioned above, with the use of geogrids, higher and steeper slopes can be constructed, which in turn leads to cost savings.

Pavement Design. Dynamic loads due to the vehicles are considered in the process of pavement design. The term "dynamic" refers to the continuous loading and unloading cycles applied to the pavement. As described above, the ribs of the geogrids provide lateral confinement to the base course or other layers and, in turn, prevent them from moving away from the base course. In this way, the thickness of the base course remains constant; hence, the pavement becomes more durable under dynamic loads.

Foundations. Foundations (e.g., foundations of a building) provide a specific geotechnical engineering problem. For example, the load from the superstructure should be conveyed to the earth materials in a way that satisfies both stability and serviceability criteria (i.e., the ultimate load should not exceed the bearing capacity of the soil, and a total displacement of the soil layers should not exceed a predetermined value). Lateral confinement provided by geogrid increases the shear strength of the soil layer, thereby increasing the ultimate bearing capacity of the foundation. In some implementations, special problems occur in foundation engineering. For instance, if a weak compressible layer is located between two strong layers, there may be lateral squeezing out of the soft layer. Lateral confinement may be provided to solve this problem, for example, in the form of geogrids.

Referring to FIG. 2A-2L, examples of spider-web-inspired geogrids as biomimics are shown that employ geometric and topologic characteristics of spider webs that can address geotechnical engineering infrastructure problems, such as grade separation, pavement design, and foundation design by increasing the lateral confinement of the soil layer more efficiently compared to commercially available geogrids and thereby increases the shear resistance of the soil more than that of commercially available geogrids. The spider-web-inspired geogrid has unique aperture size distribution, including triangular, parallelogram, and trapezoidal apertures that are analyzed, modeled, and optimized into the provided design. Like the effect of grain size distribution on the soil behavior, the aperture size and shapes can influence the overall geogrid efficiency to maximize the lateral confinement.

In each of the FIGS. 2A-2L, the unit cell is defined by a line as structural members, also referred to as a beam member. The beam members may have a constant or varying cross-sectional area. Circles are shown in the unit cell to define a corner or an edge in providing the geometric definition for the geogrid unit cell and are not implemented in the actual geogrid. The geogrid, as an article of manufacture, is formed of a continuous corner (e.g., shown as 120'). The corners may be tapered.

Figure 2A:
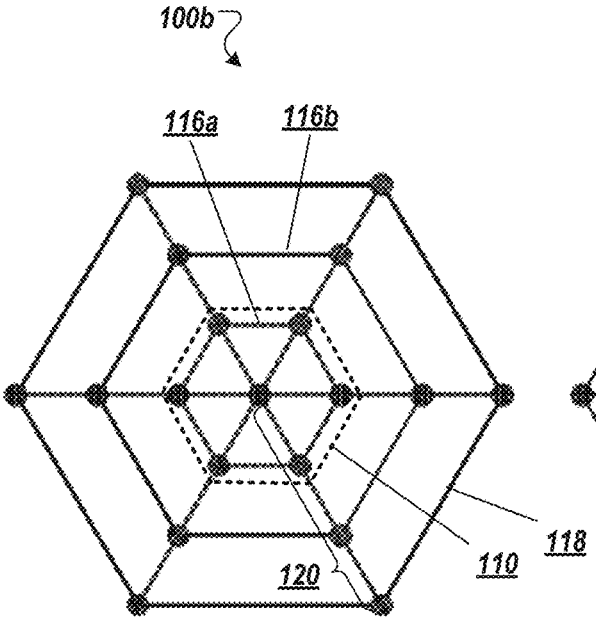
FIGS. 2A, 2B, 2C, 2D, 2E, 2F, 2G, 2H, 2I, 2J, 2K, and 2L each show example configurations of spider-web-inspired geogrid having a center interconnection, e.g., as described in relation to FIG. 1, in accordance with an illustrative embodiment.
Figure 2B:
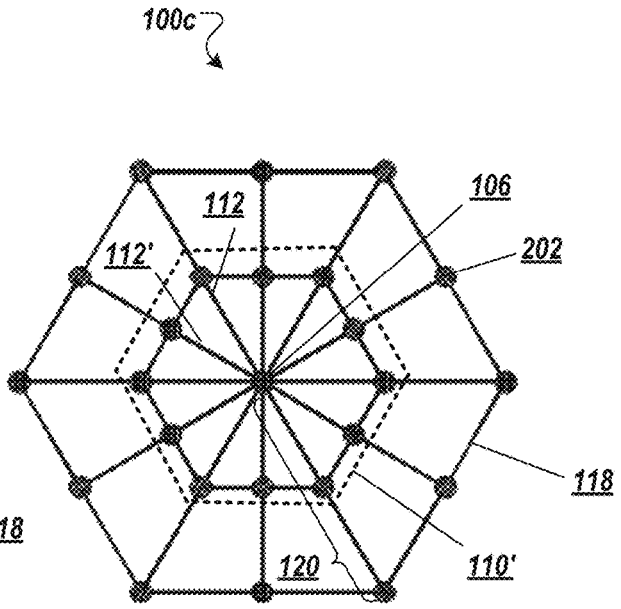
Figure 2C:
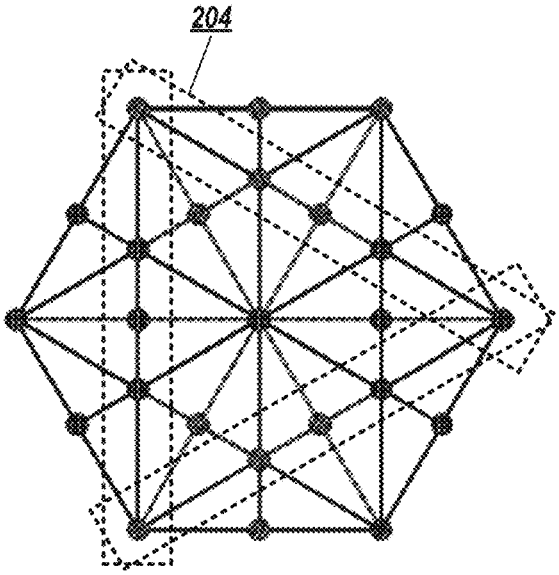
Figure 2D:
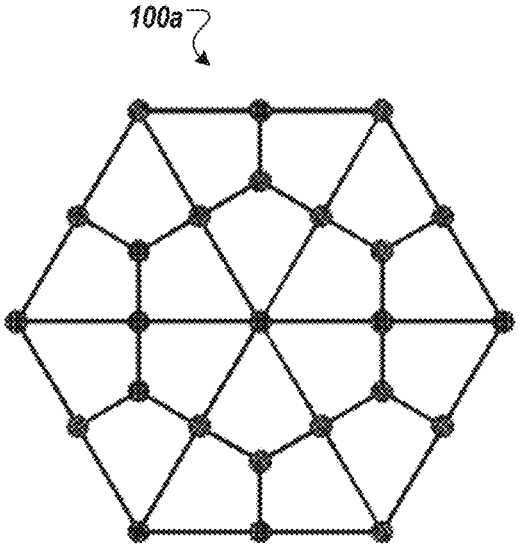

In FIG. 1, the geogrid in diagrams 101*a*, 101*b*, and 101*c* are shown for illustrative purpose and are not the same. In diagram 101*a*, an example application of a geogrid (for a triaxial design) in pavement is shown. In diagram 101*b*, an example modeling of a geogrid (for an InterAx design) is shown. In diagram 101*c*, an example pattern of an exemplary biomimic spider-web inspired geogrid of FIG. 2D is shown.

In each of FIG. 2A-2L, the unit cell of a geogrid (100*a*, 100*b*, 100*c*, 100*d*, 100*c*, 100*f*, 100*g*, 100*h*, 100*i*, 100*j*, 100*k*, 100*l*) is shown in which the unit cells, a set of repeating polygons, are repeated to form a substantially planar layer (e.g., of polymeric material or other material described herein, e.g., filament based structure) to provide a pattern to provide lateral confinement of a geotechnical environment to restrict displacement of aggregates. The pattern in each of FIGS. 2A-2H includes a plurality of interlocking beam members 104 to form the repeating set of polygonal unit cells each having at least 6 sides (e.g., at least a hexagonal). The repeating set of polygonal unit cells has (i) a center 106 and (ii) a plurality of repeating apertures 108 formed in between the interlocking beam members. Each of the repeating sets of polygonal unit cells 102 has a center interconnection 112 to which multiple continuous ribs members 112 and associated apertures 114 extend and connect to lateral members defining radial transect boundaries 116 of the geogrid unit cell 102. In FIG. 1, the geogrid pattern 100*a* had a single radial transect boundary 116 that also defines the center interconnection. Each pattern 100*a* has a unit cell boundary 118. Notably, the rib members 112, as a primary structure for the unit cell, extend continuously (120) from the center interconnection to the unit cell boundary 118. The corners 122, 124 (e.g., shown as 122', 124', respectively) of the radial transect boundaries 114 and unit cell boundary 116, and the center 106 (shown as 106') may be tapered to different degrees. In some embodiments, the corner 122 and center 106 may be similarly tapered.

The number of rib members 12 can include 3, 4, 5, 6, 7, 8, 9, 10, 11, or 12 ribs. In some embodiments, the number of rib members can be greater than 12. FIGS. 2I-2L shows the unit cell of the geogrids 100*i*, 100*j*, 100*k*, 100*l*, configured as an octagon, decagon, dodecagon, and icosagon, respectively. The various shapes may be modified per the pattern shown in FIG. 2A-2H. In forming the geogrid with the unit cell, the edges of adjacent cells can be linked together. In some instances where gaps are formed between the cells, a secondary cell may be created.

Multiple radial transect boundaries. FIG. 2A shows an exemplary bio-mimic spider-web inspired geogrid 100*b* having multiple radial transect boundaries 114 (shown as 114*a*, 114*b*). As shown in FIG. 2A, the rib members 112, as a primary structure for the unit cell, extends continuously (120) from the center of the center interconnection 110 to the unit cell boundary 118.

The number of radial transect boundaries 114 can be 1, 2, 3, 4, 5, 6, 7, 8, 9, 10, 11, 12, 13, 14, 15, 16, 17, 18, 19, 20. In some embodiments, the number of radial transect boundaries 114 can be greater than 20.

Center Interconnection with additional connections. FIG. 2B shows an exemplary bio-mimic spider-web inspired geogrid 100*b* configured with a denser center interconnection 110 (shown as 110'). In addition to having rib members 110, the center interconnection 110' includes secondary rib members 112 (shown as 112') that extends from the center 106 to a bisect position 202 located on the unit cell boundary 118.

Center Interconnection with additional connections and cross-beams (chords). FIG. 2C shows an exemplary bio-mimic spider-web inspired geogrid 100*c* configured with the denser center interconnection 110 (shown as 110') of FIG. 2B and additional cross-beams 204 (also referred to as a chord) located between the radial transect boundaries 114 and the unit cell boundary 118.

Figure 3A:
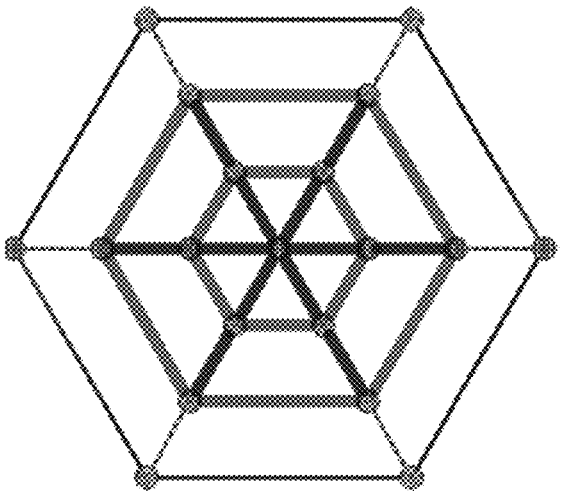
FIGS. 3A, 3B, 3C, and 3D each show a description of the rib connections and chord connections as they relate to the center interconnection, in accordance with an illustrative embodiment.
Figure 3B:
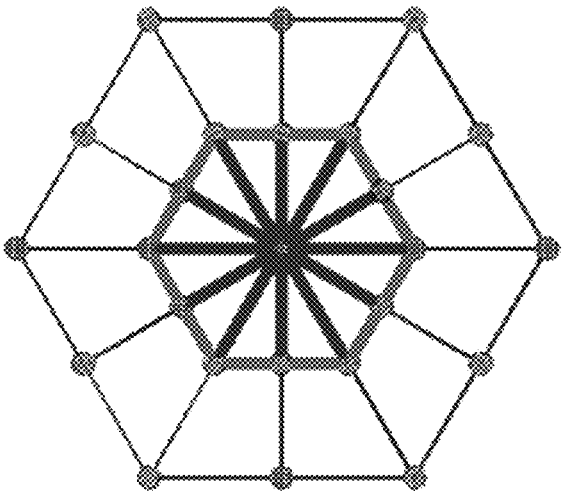
Figure 3C:
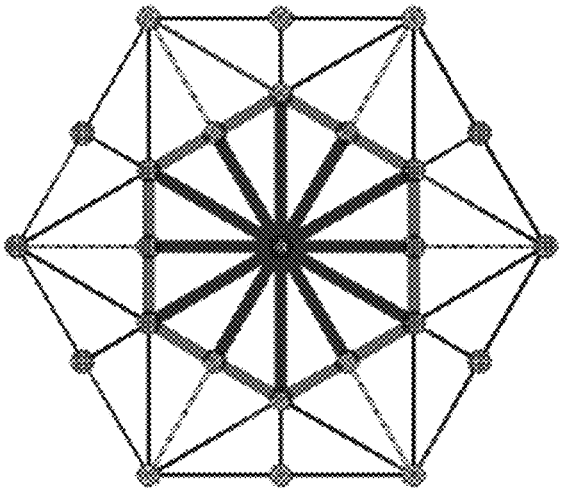
Figure 3D:
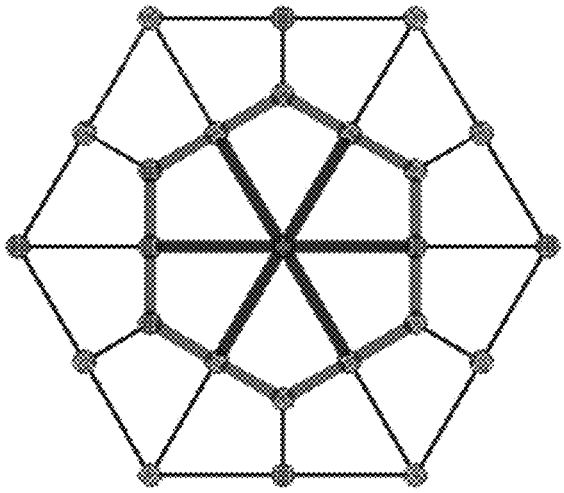

FIGS. 3A-3D each shows a definition/quantification for the rib connections and chord connections as they relate to the center interconnection. In FIG. 3A, the pattern 100*b* of FIG. 2A includes 6 radial ribs that bisect two radial transect boundaries at 12 positions. In FIG. 3B, the pattern 100*c* of FIG. 2B includes 12 radial ribs that bisect a single radial transect boundary at 12 positions. In FIG. 3C, the pattern 100*d* of FIG. 2C includes 12 radial ribs that bisect one radial transect boundary at 12 positions having a corresponding set of 12 chords. In FIG. 3D, the pattern 100*a* of FIG. 2D includes 6 radial ribs that bisect the radial transect boundaries at 12 positions having a corresponding set of 12 chords.

Center Interconnection Rotated with Respect to Radial Transect Boundary. FIG. 2D shows the example shown in FIG. 1. Additionally, FIG. 2D also shows the center interconnection including a first continuous rib, a second continuous rib, and a third continuous rib that each extends from the center of the repeating set of polygonal unit cells. The pattern includes a set of beams forming the radial transect boundaries having a first shape, and the boundary sides of a repeating polygonal unit cell has a second shape. The first shape and the second shape are the same, and the first shape is rotated 30 degrees from the second shape.

Edge-to-Edge connection of Unit-Cells to Generate Multi-Cell with Secondary Structures. FIGS. 2E, 2F, 2G, and 2H each show another class of bio-mimic spider-web inspired geogrid 100 (shown as 100*d*, 100*e*, respectively) in which the unit cells of a smaller unit cell is repeated in part or in whole with a center unit cell of the same and connected via edge-to-edge connections to generate multi-cell unit cell with a secondary structure. This secondary structure aids in the performance of the geogrid in infrastructure applications.

Figure 2E:
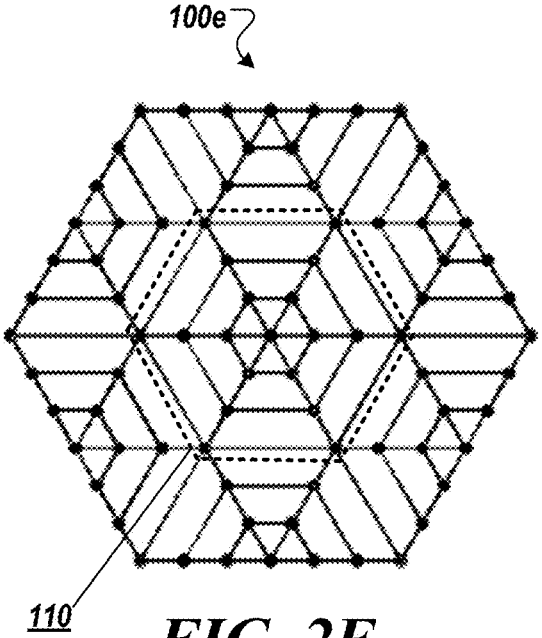
Figure 2F:
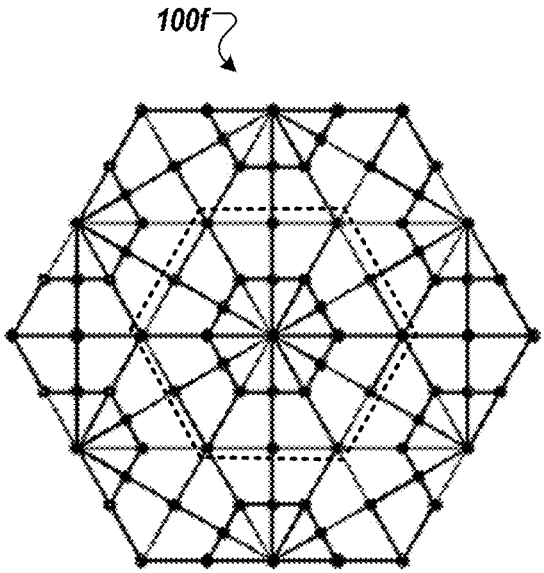
Figure 2G:
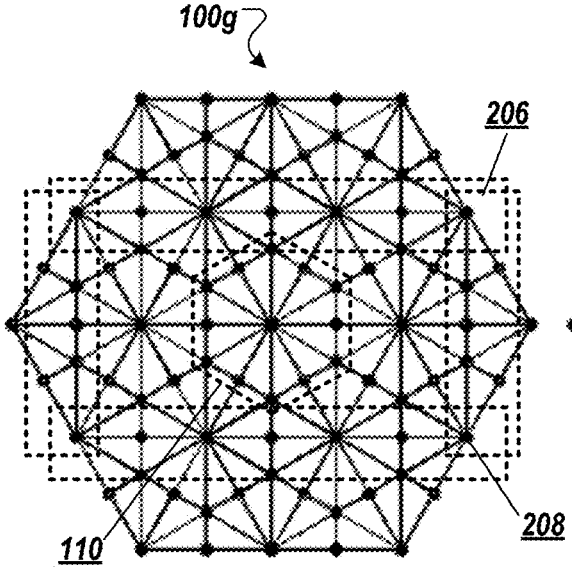
Figure 2H:
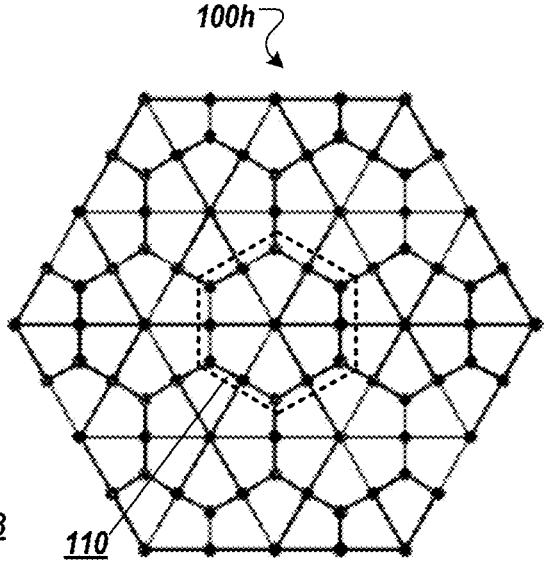
Figure 2I:
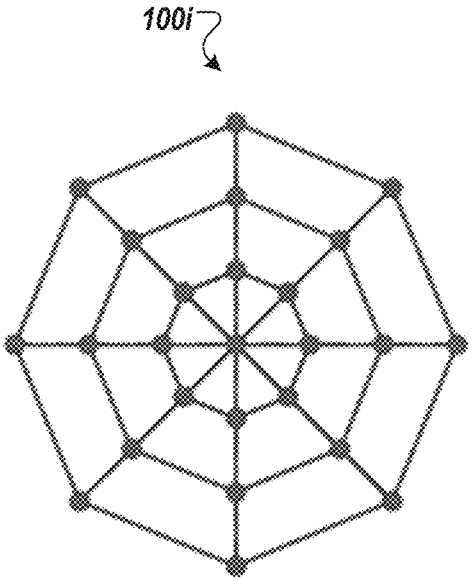
Figure 2J:
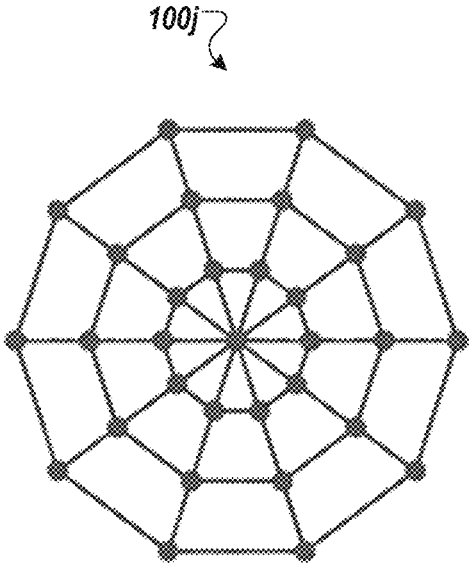
Figure 2K:
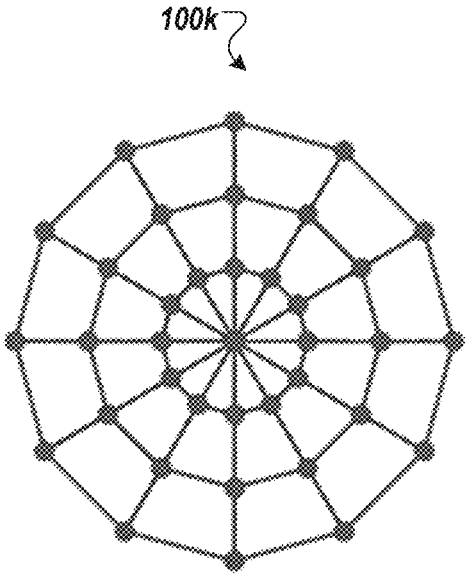
Figure 2L:
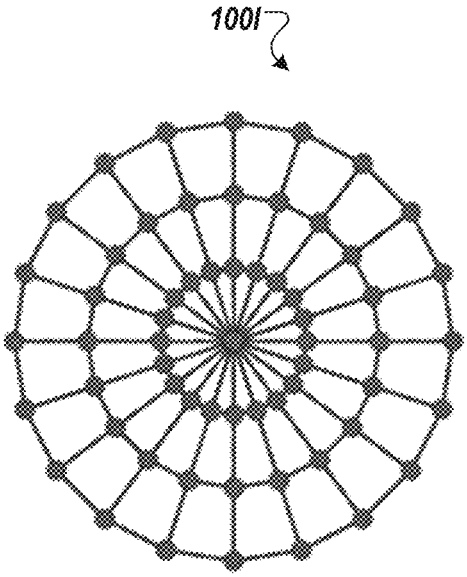

In FIGS. 2E and 2F, a portion of the smaller unit cell is repeated in part with a center unit cell of the same and connected via edge-to-edge connections to generate multi-cell unit cell. In FIGS. 2G and 2H, a first set of smaller unit cells comprising only the center interconnection 110 is repeated in whole around the center unit cell of the same and then connected via edge-to-edge connections to generate multi-cell unit cell. A second set of the smaller unit cells is repeated in part (one-third of the center interconnection) to form the remainder of the multi-cell unit cell.

Figure 4A:
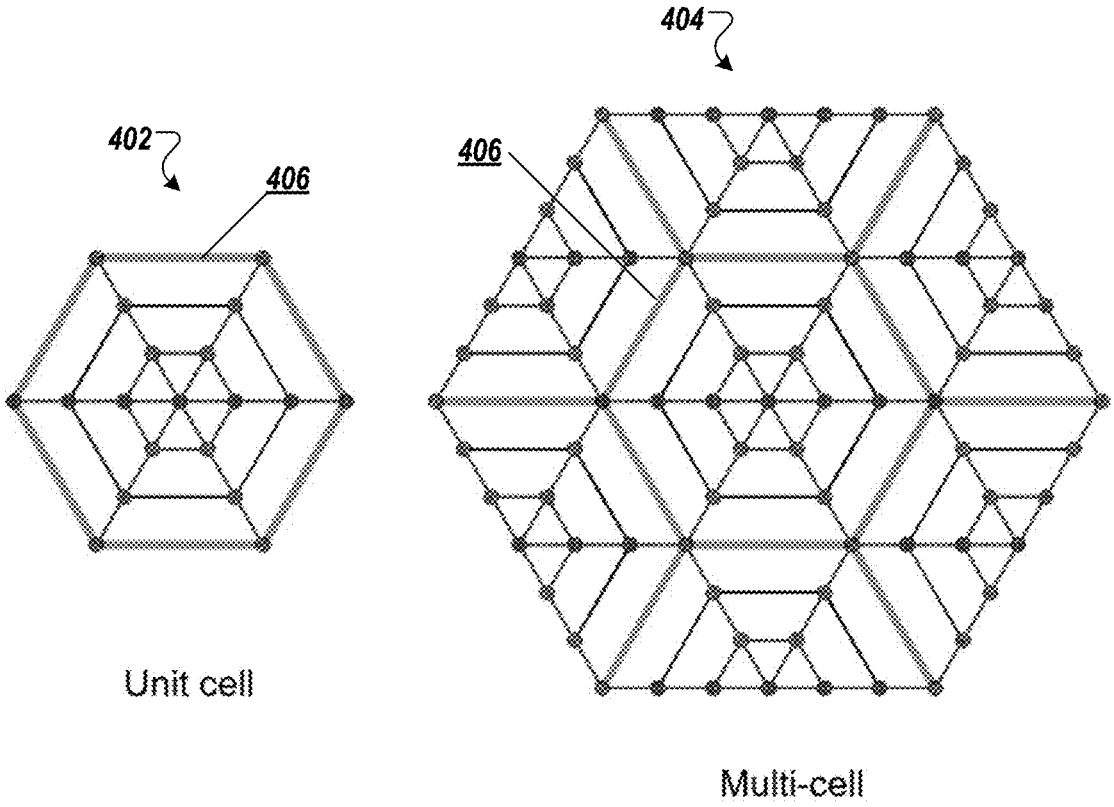
FIG. 4A shows a sub unit cell arrangement of a spider-web-inspired geogrid having a center interconnection, along with a multi-cell arrangement, according to one implementation.
Figure 4B:
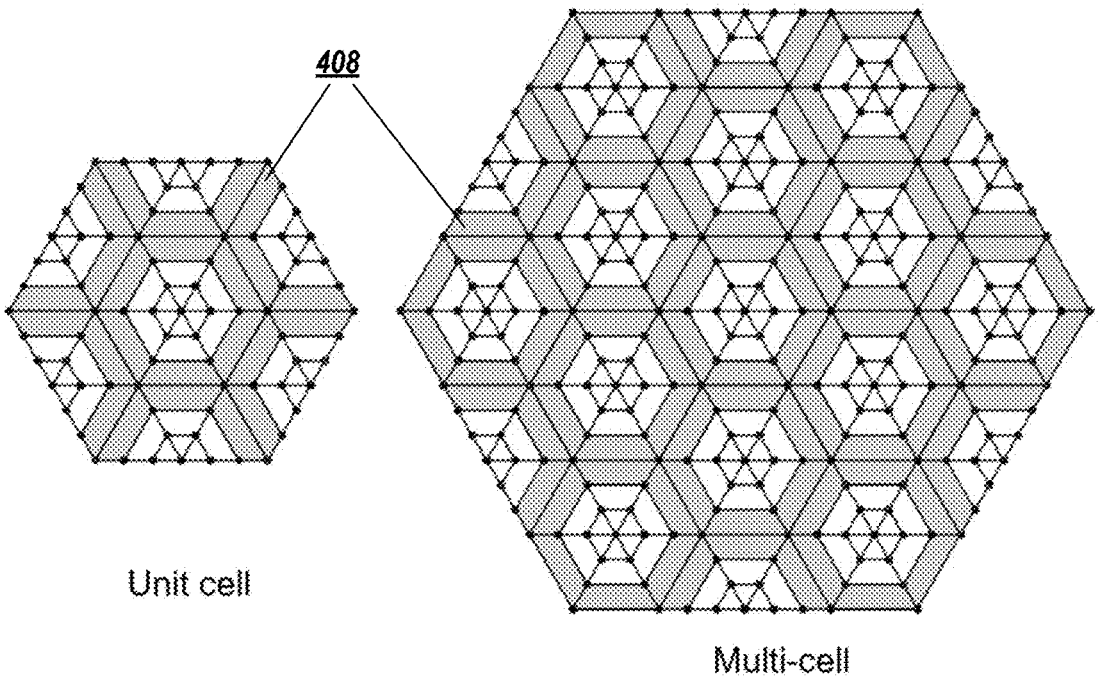
FIG. 4B shows a sub unit cell arrangement of a spider-web-inspired geogrid having a center interconnection, along with a multi-cell arrangement, according to another implementation.

FIG. 4A shows the sub unit cell 402. A portion of the sub unit cell 402 is repeated 6 times and attached on an edge-to-edge basis to generate a larger multi-cell unit cell 404 having a secondary structure. The boundaries of the sub unit cell 402 is shown as 406. FIG. 4B shows the sub unit cell 402 and multi-cell unit cell 404 of FIG. 4A with regions 408 forming a larger trapezoidal cell in structure as a secondary structure.

As shown in FIG. 4A, the plurality of repeating apertures has a range of primary axis orientations. The plurality of repeating apertures also includes at least one of square-, rectangular-, triangular-, deltoid-, parallelogram-, and trapezoidal-shaped apertures.

Other relationships also exist. For example, FIG. 2G can also be viewed as FIG. 2C having the cross beam 204 from the corners of the unit cell boundary 118 and additionally having additional cross beams 206 from a bisect position 208 among the unit cell boundary 118.

FIG. 2H can be viewed as FIG. 2D having a first set of sub unit cell comprising the cell interconnection being repeated in whole. A second set of the smaller unit cell is then repeated in part (one-third of the center interconnection) to form the remainder of the multi-cell unit cell.

Method of Design and Optimization

Figure 4C:
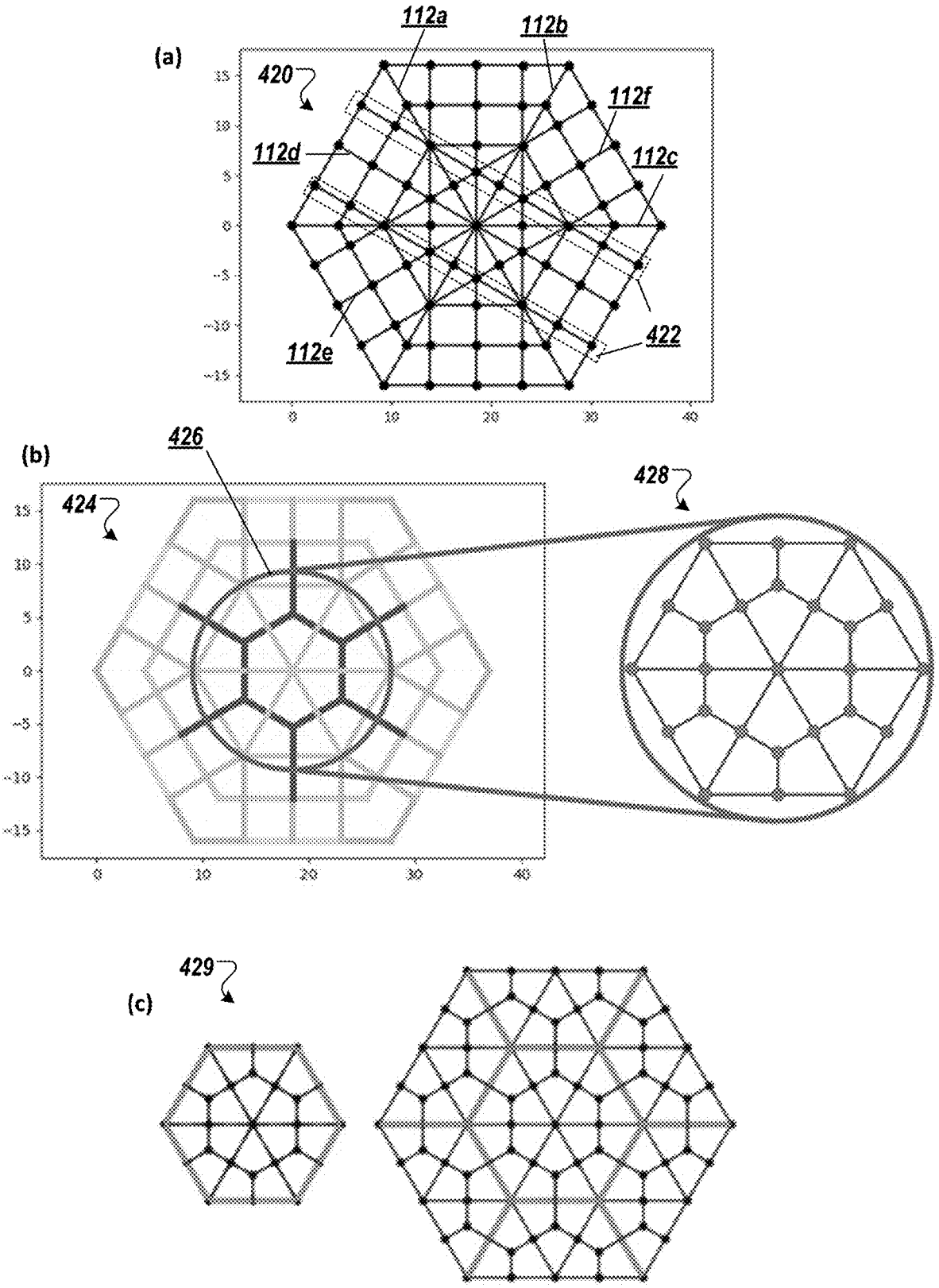
FIG. 4C shows an example method of design of the geogrid and its optimization.

FIG. 4C shows an example method of design of the geogrid and its optimization. In FIG. 4C, a complex geogrid 420 is formed having the three ribs 112 (shown as 112*a*, 112*b*, 112*c*) formed in the center interconnection. The geogrid pattern further includes (i) additional ribs 112 (shown as 112*d*, 112*e*, 112*f*) that traverses the center 106 and (ii) secondary rib structures 422 that are parallel to the additional ribs 112*d*, 112*c*, and 112*f*. An optimization can be performed that include reducing the number of radials while keeping the number of transection connections and chord connections the same (see diagram 24). Then, also in diagram 424, the unit cell 426 can then then defined as a portion of structure.

Structural optimization procedure. The optimization can be performed by structural and energy analysis to provide a stiffer composite response by reducing the strain energy stored in the geogrid. Part of the effectiveness of a geogrid structure can be linked to the lateral restraint it provides to the system. The lateral restraint can be related to the stiffness of the structure. With a stiffer response, the lateral restraint in the system would be more effective. To maximize stiffness or minimize compliance, the strain energy (half of the compliance) stored in the geogrid system under a load application should be minimized. The formula to calculate compliance in the system is given, e.g., in Equation 1.

$$c = f^t K^{-1} f \quad \text{(Eq. 1)}$$

In Equation 1, c is the compliance, f is the force vector, and K is the stiffness matrix. To determine which system can have a lower strain energy but meanwhile keep the mass constrained, a mass-constrained compliance minimization algorithm can be applied. A penalization can also be applied in structural optimization. Instead of defining the relationship between bar area, which can be used to define geogrid ribs, and stiffness linearly, a non-linear relationship may be defined using penalization. Using penalization in structural optimization can be considered as forcing the system to choose between whether a component in the system is necessary or not. Some of the methods that utilize penalization are called SIMP (Solid Isotropic Material with Penalization) and RAMP (Rational Approximation of Material Properties) (Eschenauer and Olhoff 2001, Stolpe and Svanberg 2001, Bendsøe and Sigmund 2004). A penalization value of 1.5 was used in the analyses conducted in the study. Other values can be used.

The total strain energy stored in one element can be calculated using Equation 2.

$$U_{el,total} = \frac{q\epsilon_q + p\epsilon_v}{2} \quad \text{(Eq. 2)}$$

In Equation 2, q is the deviatoric stress, $\varepsilon_q$ is the deviatoric strain, p is the mean effective stress, $\epsilon_v$ is the volumetric strain. The total normalized strain energy stored in the considered geogrid section can be calculated using Equation 3.

$$U_{norm,total} = \frac{\sum U_{el,total} V_{el}}{V_{total}} \quad \text{(Eq. 3)}$$

In Equation 3, $V_{el}$ is the element volume, and $V_{total}$ is the total considered volume.

Strain energy can be employed in the structural optimization parameter called compliance, which is related to the inverse of stiffness. Under the same load application, a system that is more compliant is less stiff. The lateral restraint condition can be employed to make the system act stiffer to retain the aggregate in-place. Fully locked aggregates can lead to the least surface (pavement) rutting because the aggregates don't have any place to move. Fully locked aggregates can be considered as illustrative of an optimal geogrid response.

The analysis can apply a circular area loading in the structural optimization code, e.g., provided by Kennedy (2021) to mimic the traffic load. Stress distribution under a uniformly loaded flexible circular area solution was provided by Ahlvin and Ulery (1962). The solutions can be implemented in the structural optimization code. Then, a complex spider-web-inspired geogrid design can be uploaded to the system. The reason for the selection of a 'complex' design was to allow the structural optimization code to select the unnecessary ribs in the system. Diagram 420 shows the complex spider-web-inspired geogrid design and optimization analysis result (Diagram 424). Specifically, Diagram 424 shows a complex spider-web-inspired geogrid design (left) and optimization output (right).

Based on the optimization output, certain ribs can be removed via numerical analysis, especially in the center region. The part that is encircled in FIG. 4C was determined as the optimization output. Also, the region that was encompassed with the circle 426 was determined, via the analysis, as the unit cell of the optimized spider-web-inspired geogrid. The final geometrical pattern is a hexagon that includes six equilateral triangles, in which node at the center of gravity of each of the triangles is connected to the middle of the edges. With the connection of the center of gravity nodes of each of the triangles to the adjacent triangle, the rib pattern illustrated in diagram 428 is obtained.

FIG. 4C shows a second optimization example. In real-world applications, geogrids are placed in pavement structures, embankment fills, etc. In addition to unit-cell scale performance, multi-cell scale performance may also be considered. To create a multi-cell structure of a spider-web inspired geogrid, unit-cells may be integrated to one another from their edges, as illustrated in diagram 429. Diagram 429 shows a unit-cell design that can be optimized spider-web inspired geogrid (left) and a connection of each of the unit-cells to generate the multi-cell structure (right) for the optimization. The multi-cell unit cell shown in FIGS. 2E, 2F, 2G, 2H may be similarly modified and optimized.

Geogrids with Secondary Structures Formed of Varying Apertures Sizes

Figure 4D:
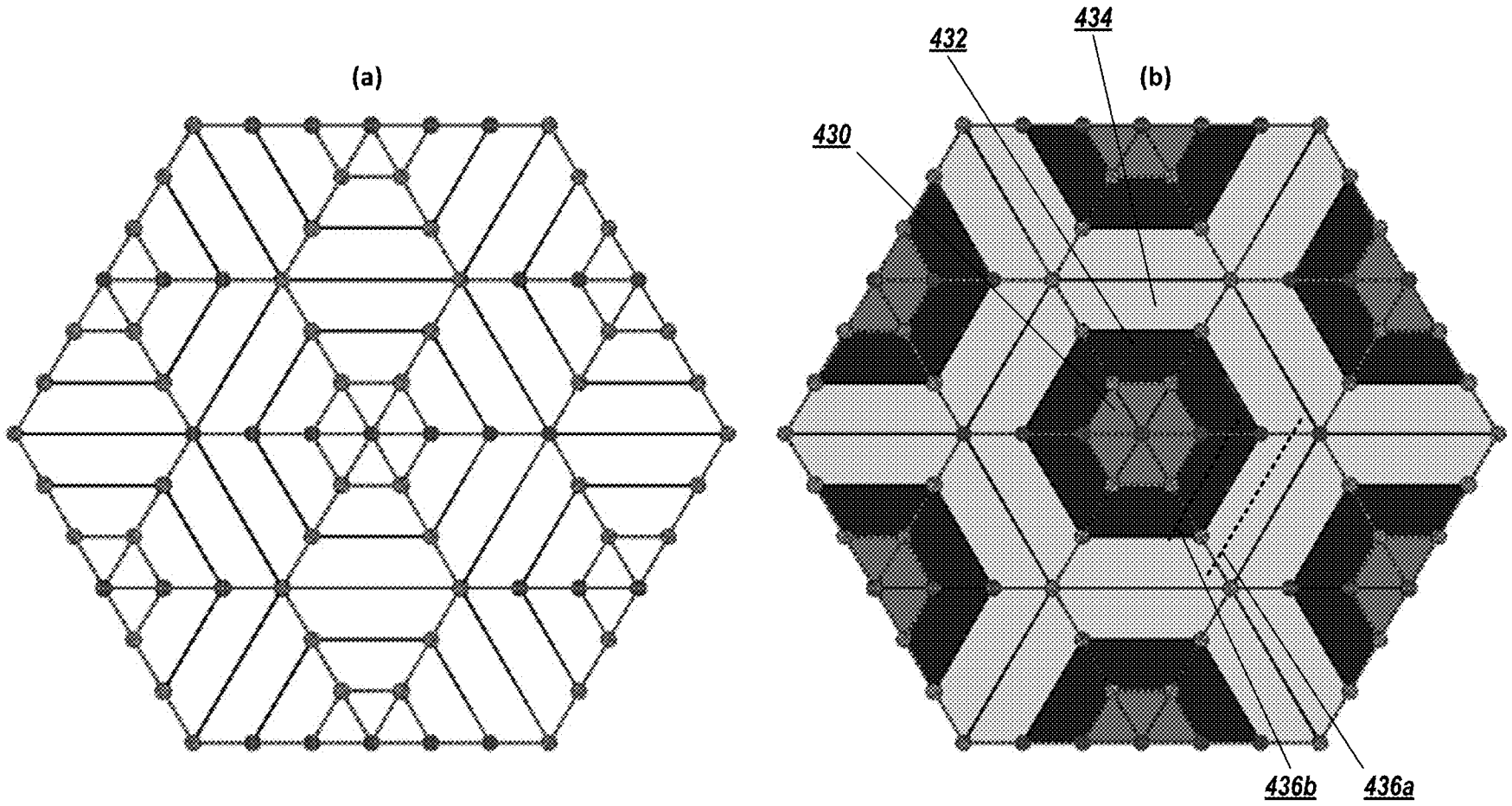
FIG. 4D shows an analysis based on aperture sizes that can be used for the optimization of the structure (e.g., as an evaluation criterion), in accordance with an illustrative embodiment.

FIG. 4D shows another analysis based on aperture sizes that can be used for the optimization of the structure (e.g., as an evaluation criterion). In FIG. 4D, different aperture sizes are shown for different shading (shown as 430, 432, 434).

The apertures are aligned adjacent to one another to form a secondary structure form.

The apertures also have a primary axis 436 (shown as 436*a*, 436*b*), having orientations that are aligned adjacent to one another to form the secondary structure form.

Geogrids With Different Opening Orientations Based on Their Long Axes

Figure 4E:
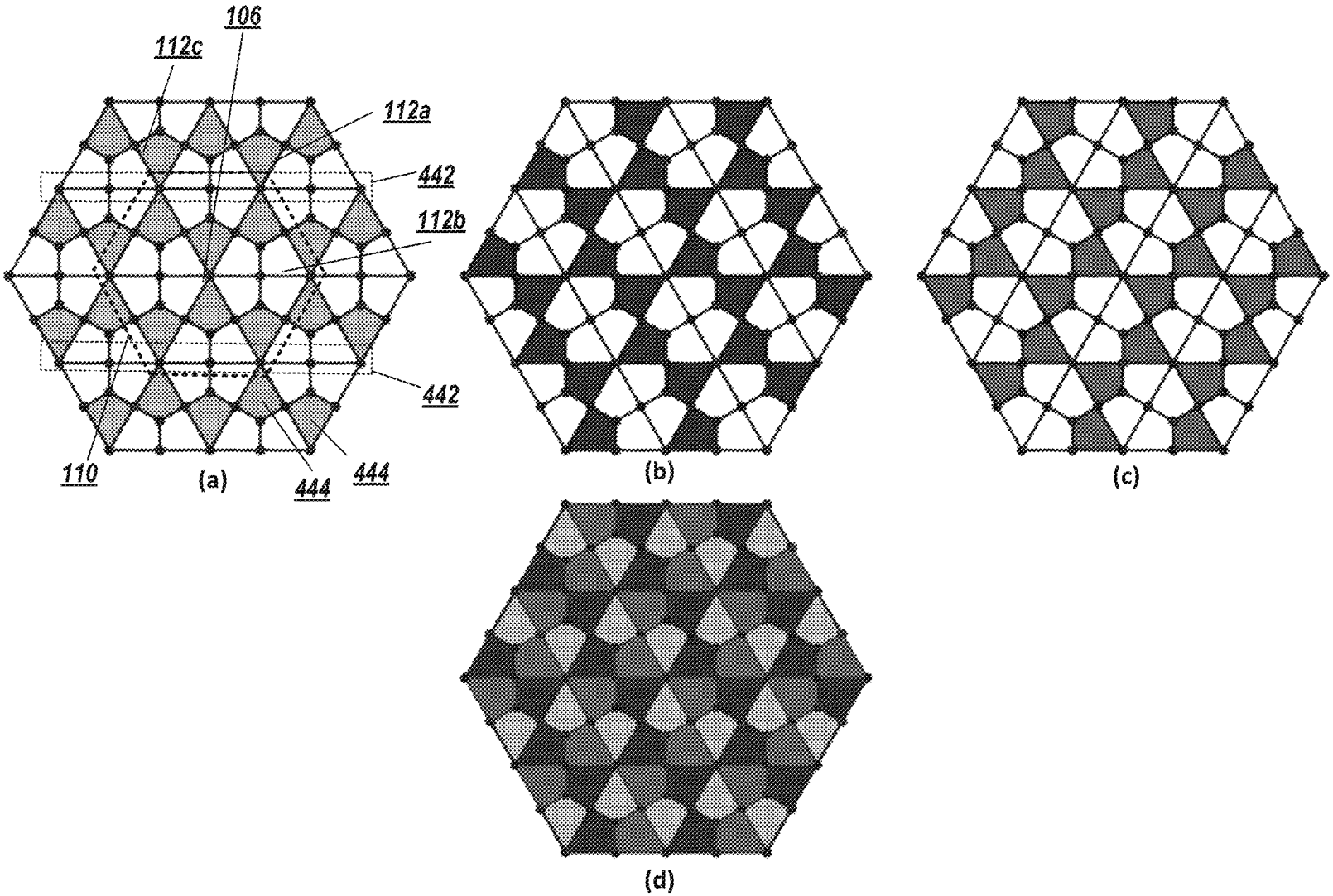
FIG. 4E shows another class of geogrids formed from three sets of apertures defined by three directions of a long axis.

FIG. 4E shows another class of geogrids formed from three sets of apertures defined by three directions of the long axis. In FIG. 4E, the center interconnection 110 includes a first continuous rib 112*a*, a second continuous rib 112*b*, and a third continuous rib 112*c* that each extends from the center 106 of the unit cell. The pattern includes a set of tertiary rib members 442 that are parallel to each of the first continuous rib 112*a*, the second continuous rib 112*b*, and the third continuous rib 112*c* to define a set of triangular secondary structures 444 that bisects tertiary rib members 442.

Experimental Results and Additional Examples

A study was conducted to develop bio-inspired geogrids. To do that, spider webs were used as an inspiration. Numerical investigations were performed for different geogrid structures, with varying geogrid embedment depths within triaxial specimens. From the study, it is understood that with approximately the same amount of material, lower maximum geogrid deformations can be obtained with different geometric arrangements.

Aperture size and visual analysis. Many commercially available geogrids consist of only one aperture size and shape, such as uniaxial, biaxial, and triaxial geogrids. Only one commercially available geogrid product, called InterAx geogrid, produced by Tensar, consists of different aperture sizes and shapes. However, these existing geogrids omit the advantageous features of this disclosure. For example, not only are the size, shape, and distribution of the apertures important, but also the number of continuous ribs has been found to be a key factor in the geogrid efficiency. Because the midsection of the InterAx geogrid unit cell is empty, it prevents every rib from becoming a continuous rib. Conversely, in the spider-web-inspired geogrid, the mid-section is not empty, which leads to having at least six continuous ribs per unit cell.

The inspiration for these types of geogrids is spider webs. Spider webs are very resilient structures in part due to the material of the spider webs. However, in this research, the shape of the spider-web structures is used as an inspiration. The structure of the spider web is an additional component of what makes spider webs durable.

Figure 5A:
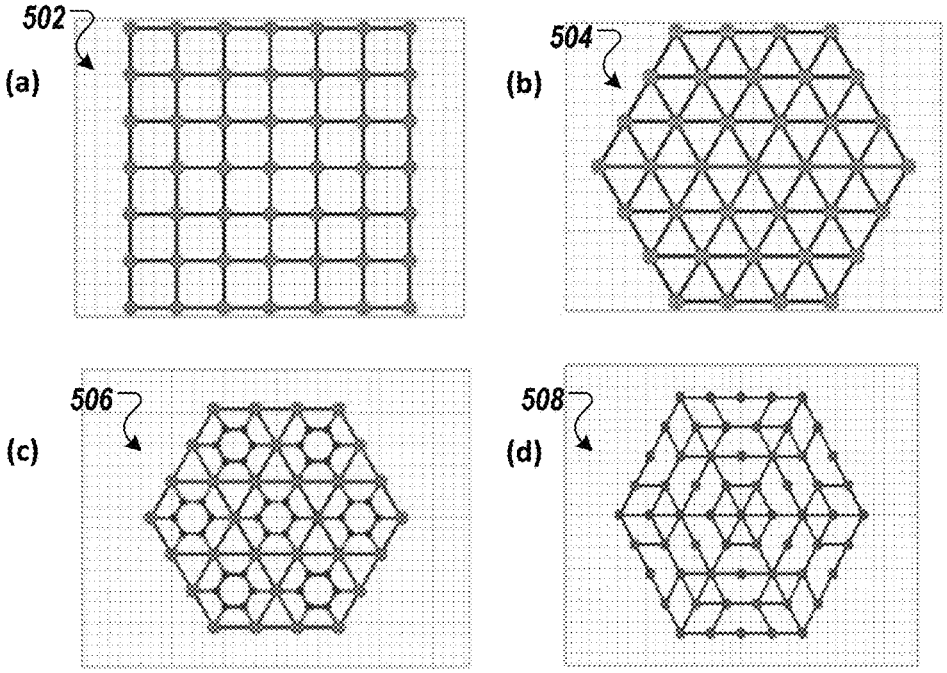
FIGS. 5A, 5B, and 5C show aperture size and visual analysis for various types of geogrid, including the spider-web-inspired geogrid of FIG. 1.
Figure 5B:
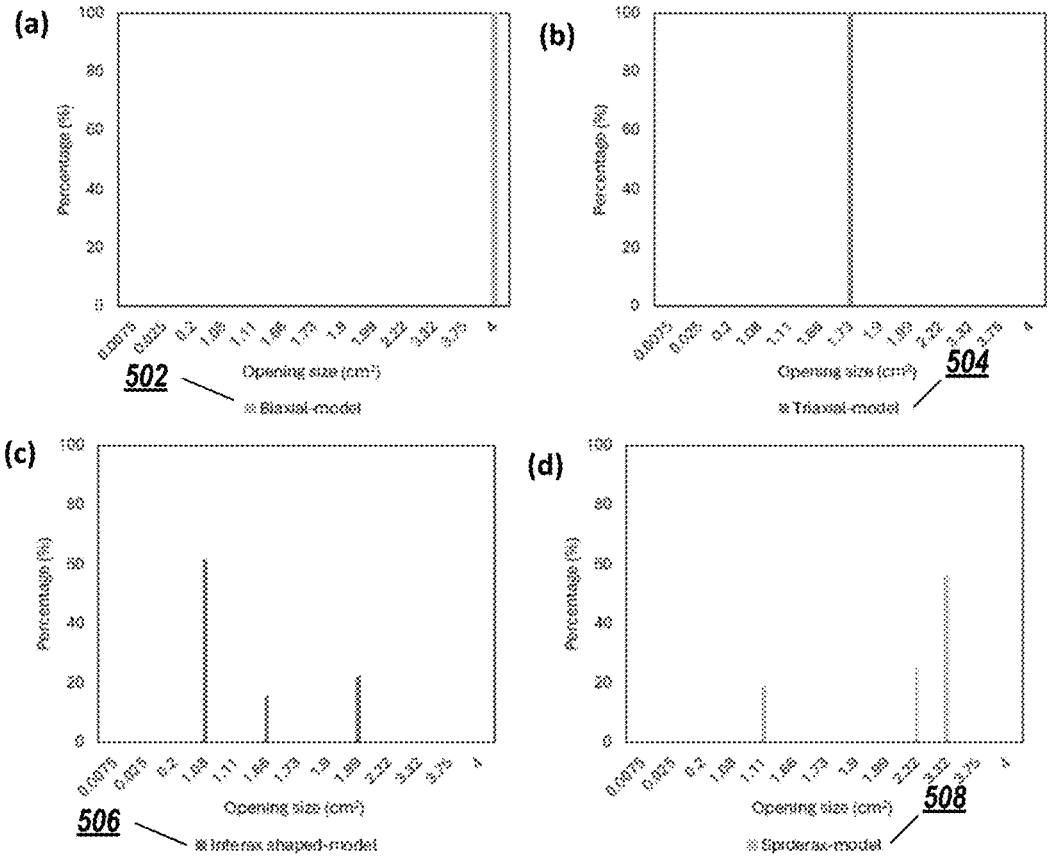
Figure 5C:
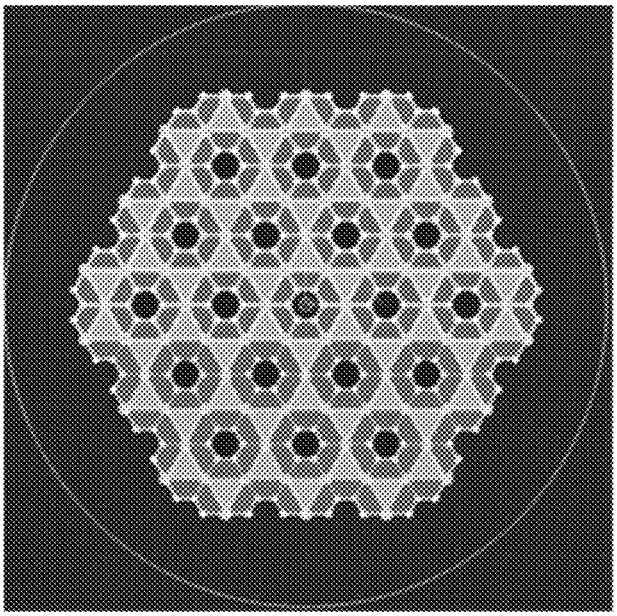
Figure 5C:
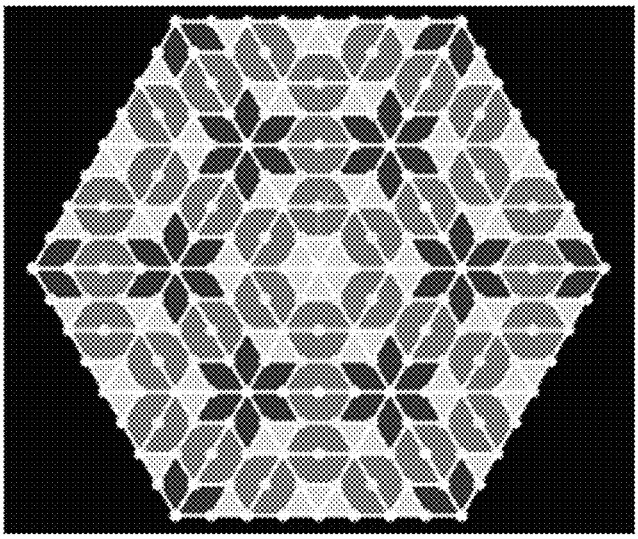

FIGS. 5A-5C shows aperture size and visual analysis for various types of geogrid, including the spider-web-inspired geogrid of FIG. 1.

In FIG. 5A, biaxial (502), triaxial (504), InterAx (506), and an example configuration of the SpiderAx spider-web-inspired geogrids (508) are depicted. The scale of the drawings should not limit the potential size of the spider-web-inspired geogrids. Nor are these drawings intended to show exactly the form of the invention; they are rather to illustrate the concept of the spider-web-inspired geogrids in contrast to existing commercial geogrids.

As shown in Fig. BA, the number of aperture distribution for the spider-web-inspired geogrids (508) includes three aperture sizes in which the largest size apertures have a higher of space. In contrast, the biaxial and triaxial designs (502, 504) have only one distribution of aperture sizes each. And while the InterAx design (506) also has multiple aperture distributions, the aperture sizes within the distribution are smaller.

A secondary distinction between the exemplary spider-web-inspired geogrids (508) and other existing geogrids (e.g., 502, 504, 506) is that when unit cells are combined in large sheets, a secondary structure emerges, as shown in the contrast in FIG. 5C. In FIG. 5C, the diagram 506' corresponds to the InterAx design 506 shown in FIG. 5A, and diagram 508' corresponds to the spider-web-inspired geogrid design 508 shown in FIG. 5A. The secondary structure aids in the performance of the geogrid in infrastructure applications.

Numerical Analysis and Optimization

Geosynthetics are commonly used products to improve, alter, and/or modify the ground conditions. As of today, we have more than a dozen different geosynthetic product types. Some of the more extensively used ones are geotextiles, geogrids, and geomembranes. Different products aim to enhance specific system deficiencies. For instance, while geomembranes are used for permeability concerns, geotextiles have a wider usage spectrum, such as separation and filtration. Among them, in most cases, geogrids are preferred to be used for strength and serviceability concerns of load bearing structures.

By definition, geogrids are planar geosynthetic products that have opening sizes (apertures) with different shapes. Geogrids are divided into sub-categories based on how many directions they are designed to perform. For instance, in most earth-retaining structure applications, uniaxial geogrid is preferred as the load that the geogrid product needs to resist is oriented in one primary direction. In contrast, for the case of geogrids placed below the asphalt layers in pavement structures, load distribution due to vehicles cannot be predicted as readily as for earth-retaining structures, and thus, it is desired to have geogrids performing in multiple directions. This scenario led to the development of biaxial and triaxial geogrids, which can behave equally in two and three directions, respectively.

Numerical methods are commonly used to model the behavior of geogrid and soil interactions. Especially after the Discrete Element Method (DEM) analysis became widespread, the works that involved reinforced soil behavior proliferated. For instance, Miao et al. (2020) investigated the effect of particle size of ballast on the pullout behavior of a triaxial geogrid. In their results, they quantified the necessary aperture size to particle size ratio of 2.69 to reach the optimum performance of the geogrid. Although the test type was different (direct shear testing) in Feng and Wang (2023) 's work, the optimum aperture size to particle size ratio of 2.53 agreed with the previous work.

Although there is plenty of other research related to DEM, the number of studies that investigated geogrid-soil interaction using Finite Element Method (FEM) in which modeling the geogrid is done as a system of openings and ribs is quite limited. A three-dimensional finite element model was created by Hussein and Meguid (2016) to observe the effect of geogrid reinforcement. They first separately model the geogrid as a nonlinear elastic-plastic material and then combined the soil and geogrid in the model box they created. According to their results, longitudinal ribs undertake the main portion of the tensile loads, while the loads that are transmitted to the transverse ribs and junctions are comparatively insignificant. Abdollahi et al. (2019) investigated the effect of geogrids and EPS Geofoam on the buried pipe systems numerically by modelling geogrids having ribs and apertures as a linear elastic-plastic material.

Spider-web is a well-known, resilient structure. It consists of mainly three parts, a denser/condensed center region, radial chords, and secondary chords that link the primary (radial) chords, as shown in the figure below. Different from the classical geogrid structures, they have different opening sizes and shapes. Combining the properties of spider webs and the applications of geogrids, in the scope of this paper it is aimed to create a spider-web-inspired geogrid and compare it with the commercially available triaxial geogrids by using FEM numerical methods.

Figure 6A:
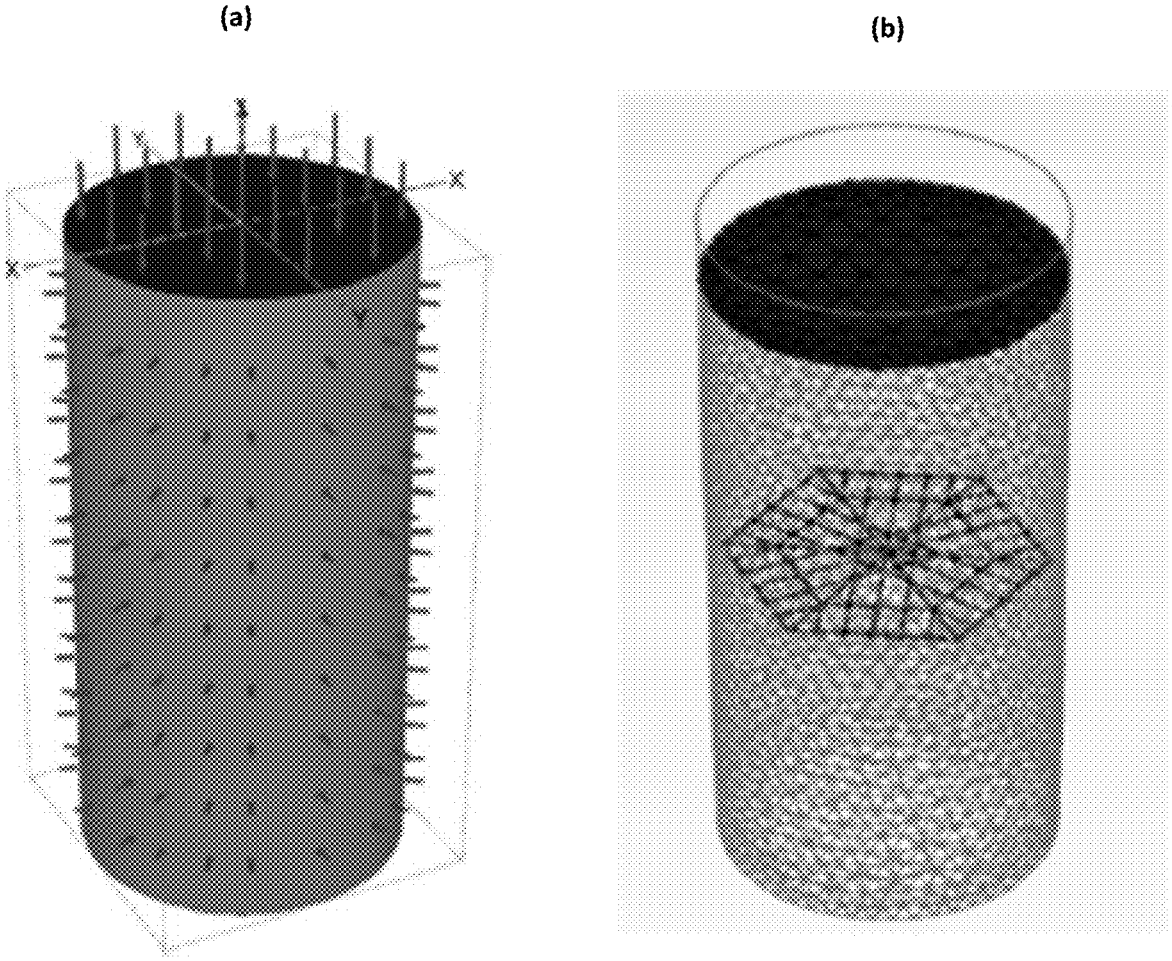
FIGS. 6A, 6B, 6C, 6D, 6E, and 6F show a numerical model and analysis of the maximum deformations for a given geogrid pattern.

Numerical Model. The study used a commercially available finite element analysis software, PLAXIS 3D, in numerical analyses. The finite element model included three different elements: backfill soil, loading plate, and geogrids. FIGS. 6A-6F show a numerical model and analysis of the maximum deformations for a given geogrid pattern. Specifically, FIG. 6A shows views of example models. Backfill soil is modeled as a 10-node tetrahedron element, while the loading plate and geogrids are modeled as plate elements, which include 6-node triangular elements. Elastic modulus and Poisson's ratio of the geogrid is obtained from literature (Skuodis et al., 2020).

In order to model geogrid reinforcement, individual ribs are modeled as a plate element. This approach that defines geogrids as a linear elastic material with an elastic modulus and Poisson's ratio was also reported in the literature (Hussein and Meguid, 2016, Abdullahi et al., 2019, Skuodis et al., 2020).

Hardening soil model is implemented to model the backfill soil behavior. This model enables the user to define the deformation characteristics of the soil more properly, as it has three different deformation parameters, whereas in Mohr-Coulomb model, deformation is captured only using one parameter. Conversely, for the strength parameters, hardening soil model does not require any other parameters compared to Mohr-Coulomb model. The only recommendation that PLAXIS has for the strength parameters is the relationship between friction angle and dilatancy angle, which is first proposed by Bolton (1986), $\psi \cong \phi - 30$. The soil, geogrid, and loading plate properties are listed in Table 1.

TABLE 1

| Property | Value | Unit |
|---|---|---|
| Soil | | |
| Model | Hardening Soil | — |
| Secant Stiffness | 20 | MPa |
| Tangent Stiffness | 20 | MPa |
| Unloading/reloading Stiffness | 60 | MPa |
| Friction Angle | 35 | ° |
| Dilatancy Angle | 5 | ° |
| Cohesion | 1 | kPa |
| Geogrid | | |
| Thickness | 0.1 | Cm |
| Elastic modulus | 57 | MPa |
| Poisson's ratio | 0.3 | — |

The triaxial test is a commonly used test method to determine the strength and deformation characteristics of particulate materials. To model an axial compression triaxial test with finite element software in this study, the process was divided into two steps. As the first step, a confinement pressure of 100 kPa was defined for both the top and circumference of the specimen. Afterward, a deviatoric stress of 200 kPa was applied to the top of the specimen. The sample was intentionally not loaded until failure because the aim was to observe the deformation behavior with and without geogrids under the same load application. FIG. 5A shows an illustration of the triaxial specimen under load application.

Figure 6B:
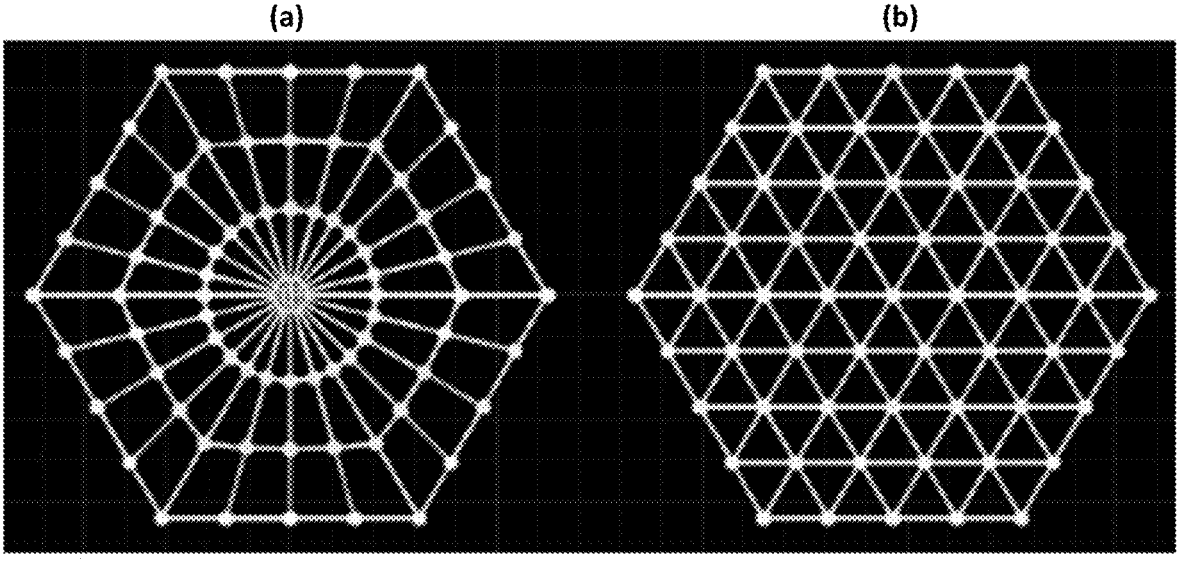

Modeling results. The study created spider-web-inspired geogrid in two steps. At first, a direct implementation of the real spider-webs properties was done. The direct implementations included a stiff center region and approximately the same angle between the radial chords; afterwards, the study conducted a series of numerical experiments to observe the behavior and compared it with the triaxial geogrid that was drawn in a way that its outer boundary is the same with the spider-web inspired geogrid. FIG. 6B shows the spider-web inspired geogrid and triaxial geogrid.

Figure 6C:
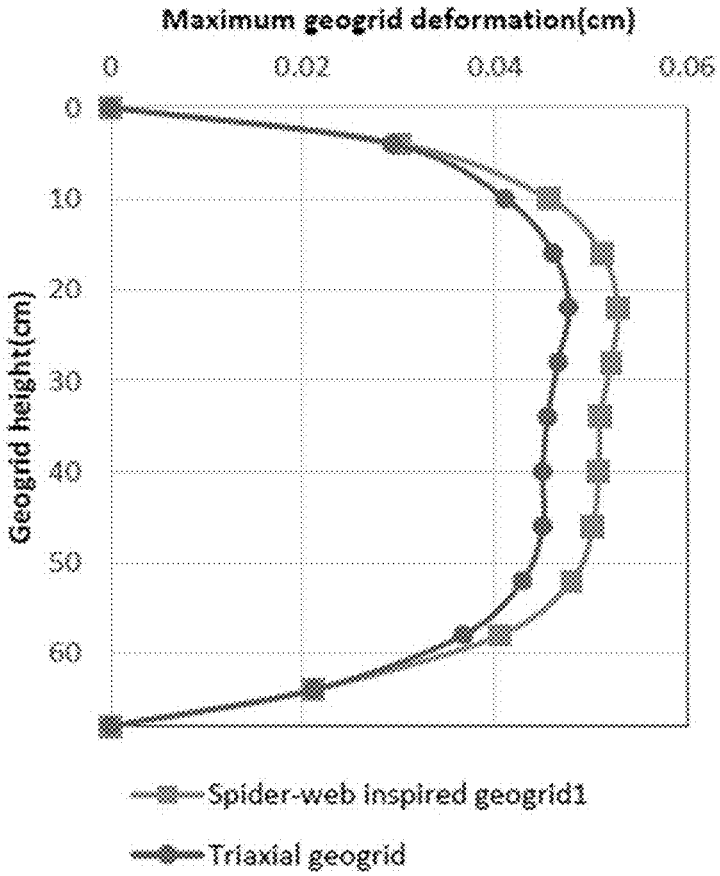

FIG. 6C shows comparison results of spider-web inspired geogrid-1 design and triaxial geogrid design. In FIG. 6C, each point represents a separate simulation, with the y-axis as the geogrid location, and the x-axis showing the geogrid deformation when the geogrid is placed at that elevation. Geogrid deformation is calculated as the vector sum of the deformation in x and y axis, excluding z-axis.

Figure 6D:
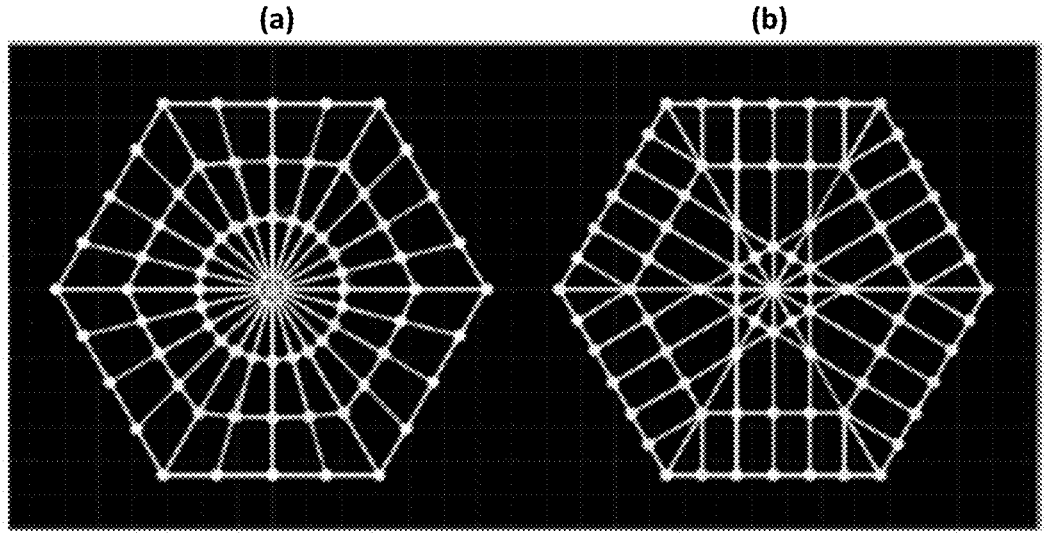
Figure 6E:
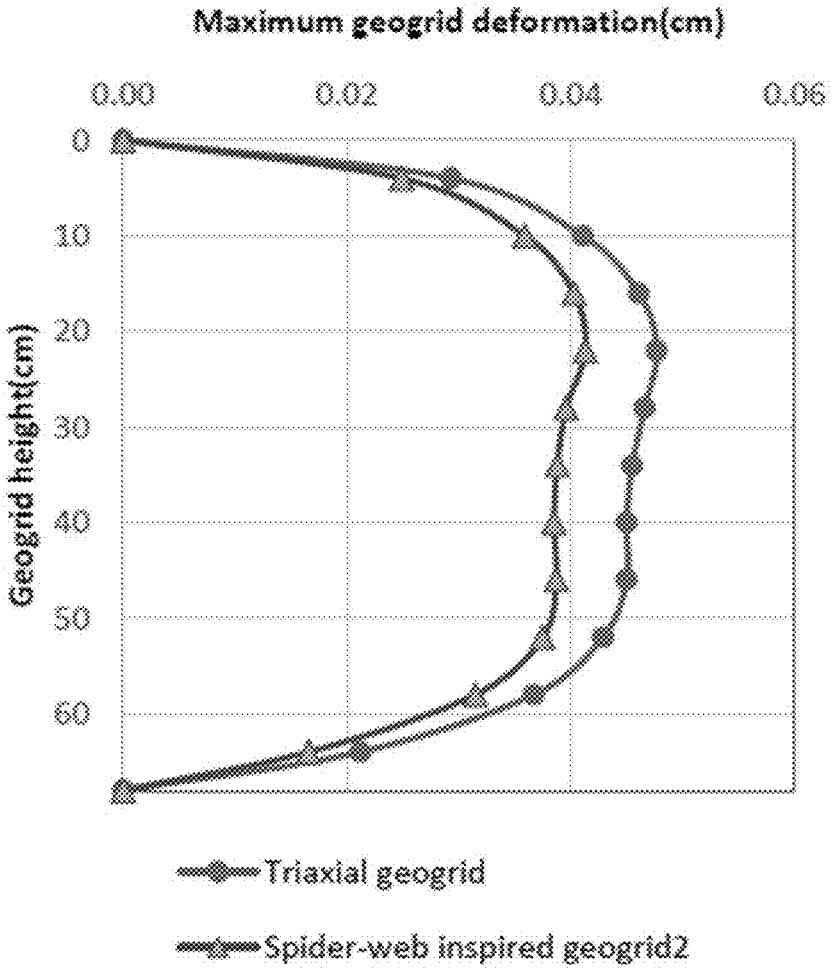
Figure 6F:
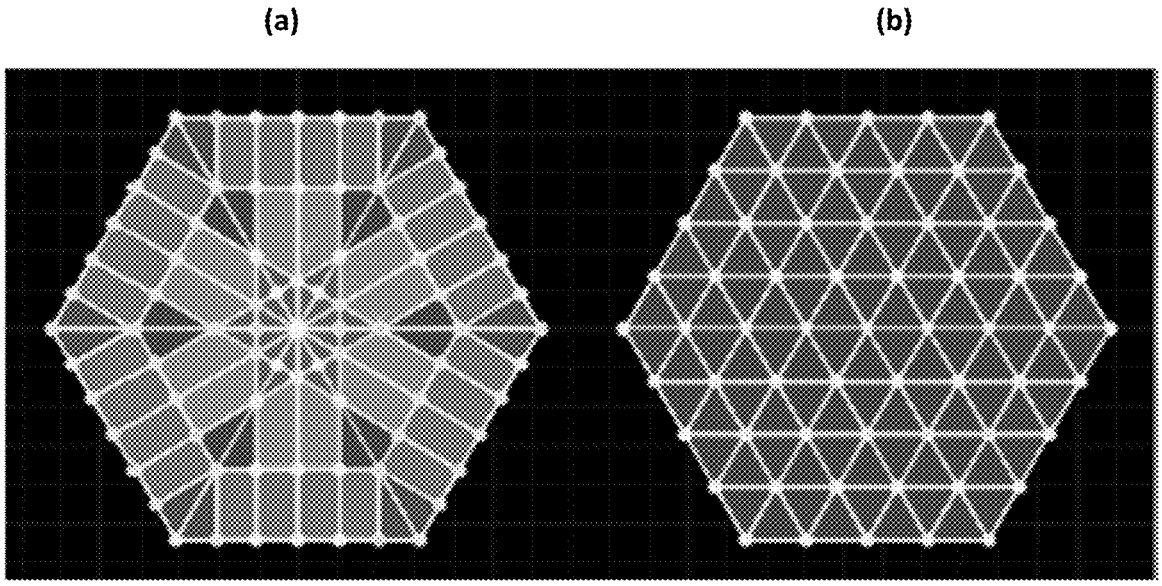

As shown in FIG. 6C, the maximum deformations of triaxial geogrids were less compared to an initial spider-web inspired geogrid for all geogrid depths, meaning that triaxial geogrid is a more stable structure in terms of load bearing compared to the first spider-web inspired geogrid. A modification was made to the first spider-web-inspired geogrid. This modification was inspired from Hussein and Meguid (2016) findings, in which they stated that the ribs that are perpendicular to the applied load are more effective to hold the load. Another spider-web-inspired geogrid was created, as shown in FIG. 6D with a comparison to the first spider-web-inspired geogrid. In this modified spider-web-inspired geogrid, the stiff center region was maintained as a dense structure again, but some of the secondary ribs were shifted to resist the load in a more effective way. A series of tests are performed with this modified spider-web-inspired geogrid, and the results are shown in FIG. 6E. As can be seen in the Figure, the modified spider-web-inspired maximum deformation obtained is significantly less than triaxial geogrid for all geogrid depths.

Figure 7A:
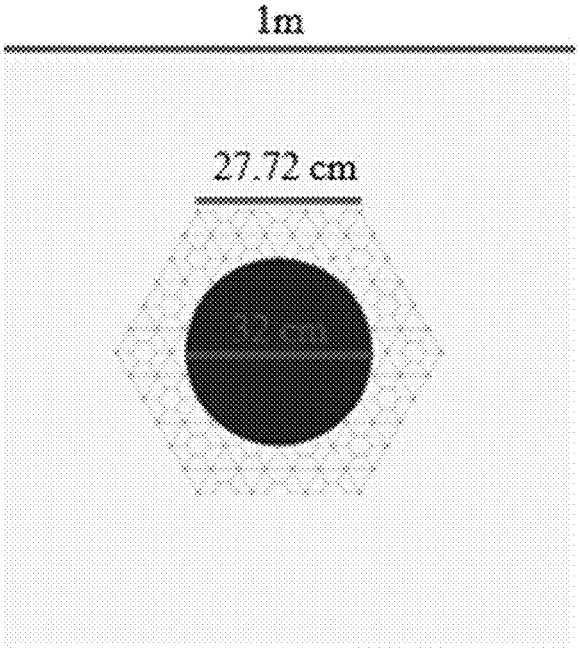
FIGS. 7A, 7B, 7C, and 7D show mesh geometric properties and evaluation using strain energy, e.g., employed in the optimization analysis of geogrid shape.
Figure 7B:
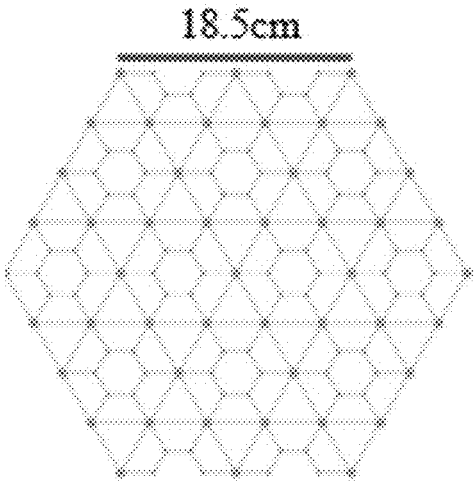
Figure 7C:
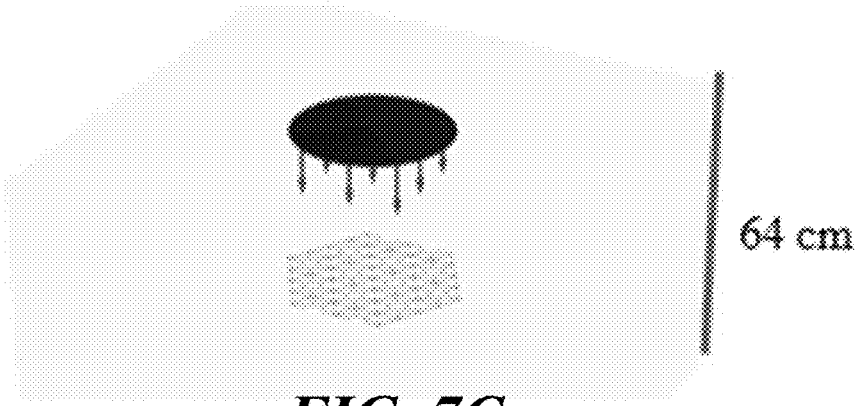
Figure 7D:
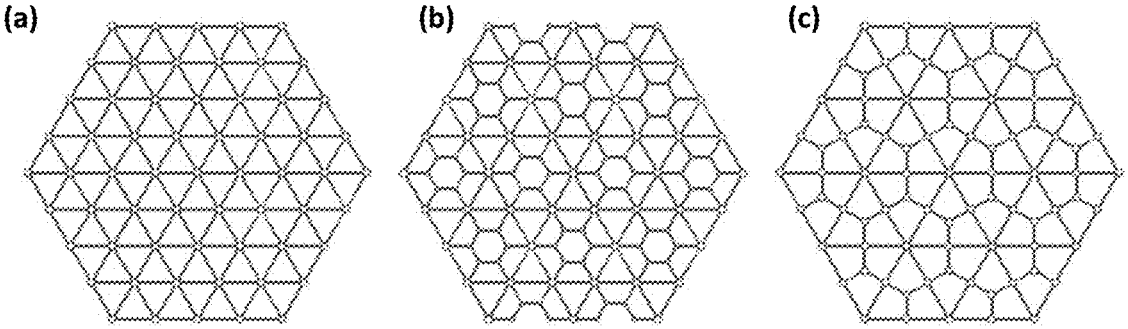

Optimization analysis. The study conducted an optimization analysis as described in relation to FIG. 4C. FIGS. 7A, 7B, and 7C show mesh geometric properties and evaluation using strain energy. Specifically, FIG. 7A shows a top view of the mesh employed in the analysis. FIG. 7B shows an example Investigated geogrid region. FIG. 3C shows the isometric view of the mesh. Geogrids are placed at the mid-height (32 cm). Surface displacement was applied (6 mm, 12 mm). FIG. 7D shows example geogrids evaluated in the analysis. Table 2 shows the results of the analysis.

TABLE 2

| When $\Delta z/B$ = 3.75% | Total normalized strain energy (kPA) | Strain Energy Difference (%) | Volume ($cm^3$) | Volume difference (%) |
|---|---|---|---|---|
| Triangular geogrid | 6.22 | — | 17.80 | |
| InterAx-shaped geogrid | 6.32 | [1.58] | 17.81 | 0.06 |
| Optimzied SpiderAx | 5.54 | 12.27 | 17.12 | 3.97 |

A surface displacement ($\Delta z$) of 12 mm was applied to a 32 cm diameter (B) loading plate. Geogrid layers were placed at a depth of B below the loading plate. Differences are relative to Triangular Geogrid. In Table 2, the result in the bolded bracket indicates the value for the InterAx-shaped geogrid has higher surface displacement (poorer performance), while the results shown in bold for the optimized geogrid show lower surface displacement (better performance).

Figure 8A:
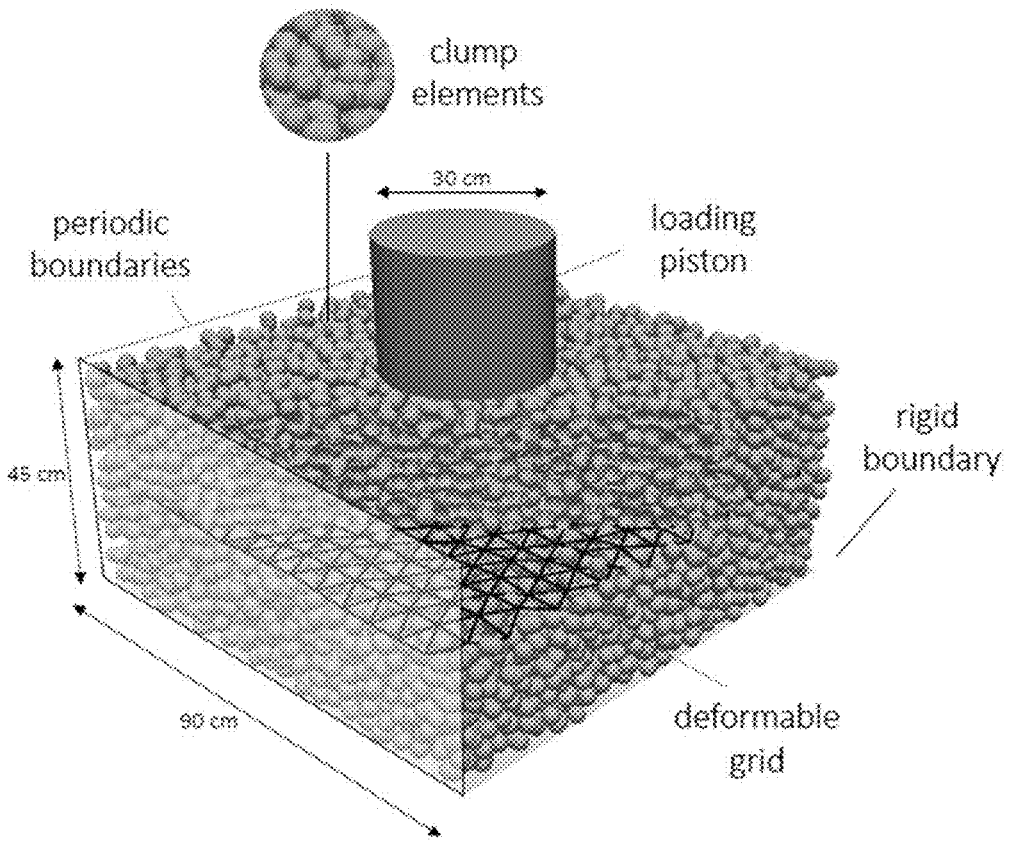
FIGS. 8A, 8B, 8C, 8D, 8E, and 8F shows modeling of soil gradation and corresponding analysis. The analysis shows that having different aperture sizes in the geogrid can improve lateral containment in the geo-environment as different aperture-sized geogrids can reduce aggregate displacements.
Figure 8B:
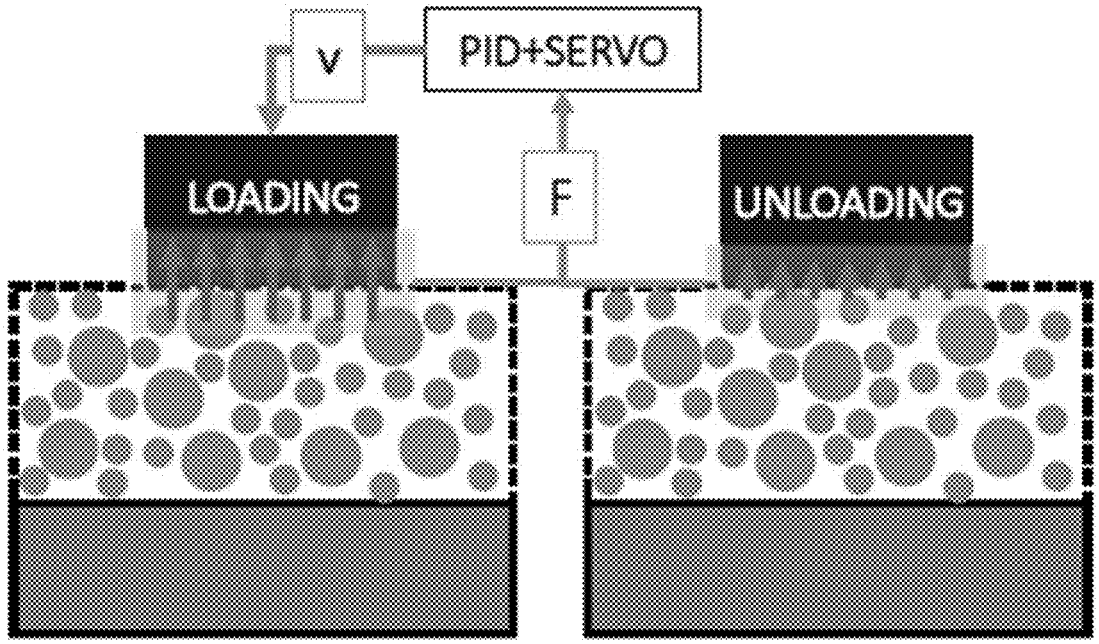
Figure 8C:
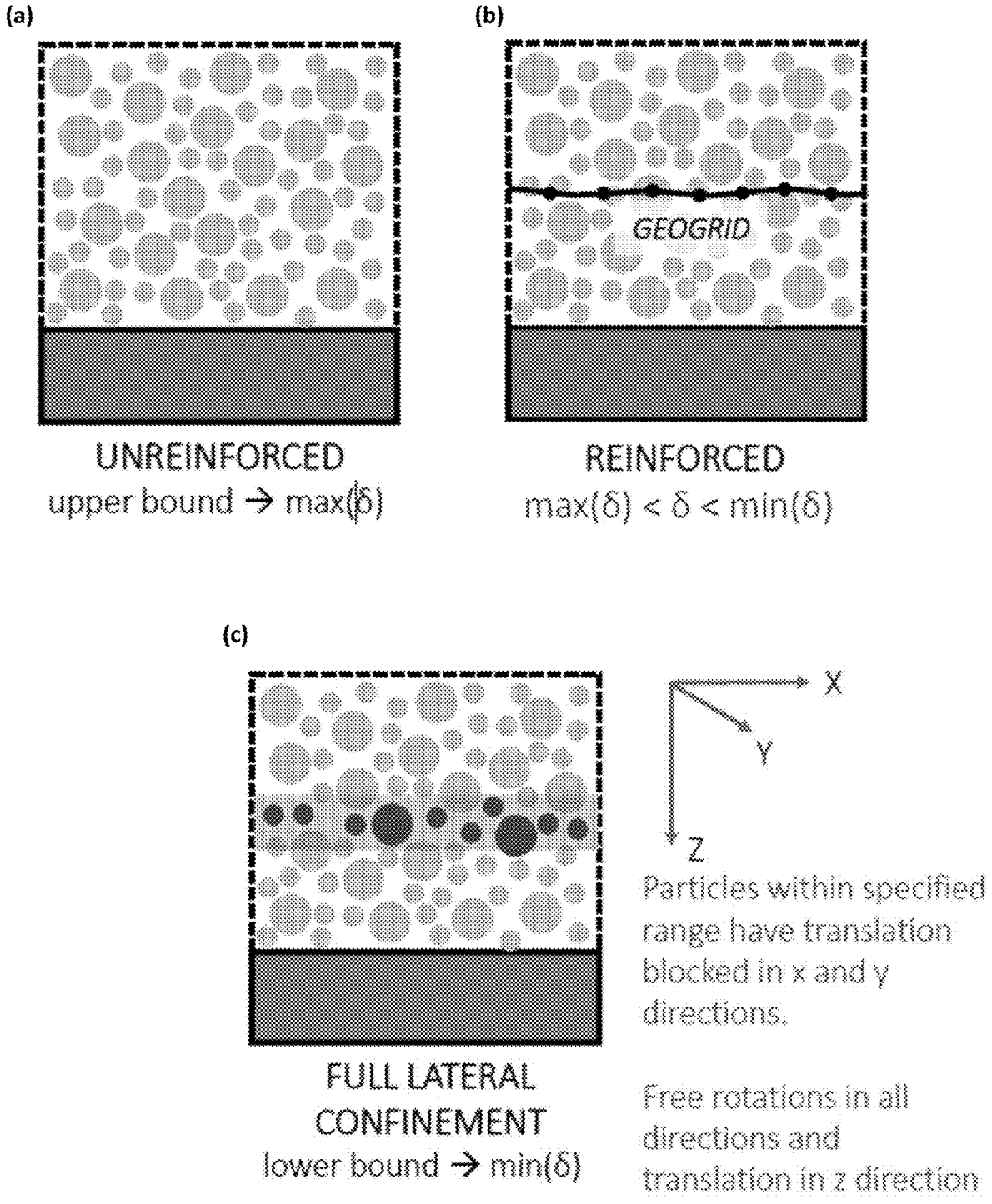

Soil gradation analysis. FIGS. 8A-8F shows modeling of soil gradation and corresponding analysis. Specifically, FIGS. 8A and 8B show additional modeling approaches using 3D DEM for soil gradation analysis. FIG. 8C shows unreinforced (sub-panel A), reinforced (sub-panel B), and full lateral reinforced (sub-panel C) models. Grids can only partially restrict the lateral displacement of aggregates. To quantify the maximum enhancement achievable using grid stabilization, the device has to laterally lock a layer. For the model, particles (e.g., aggregates) within a specified range can be allowed to have translation blocked in the x and y directions but free rotations in all directions and translation in z direction.

Figure 8D:
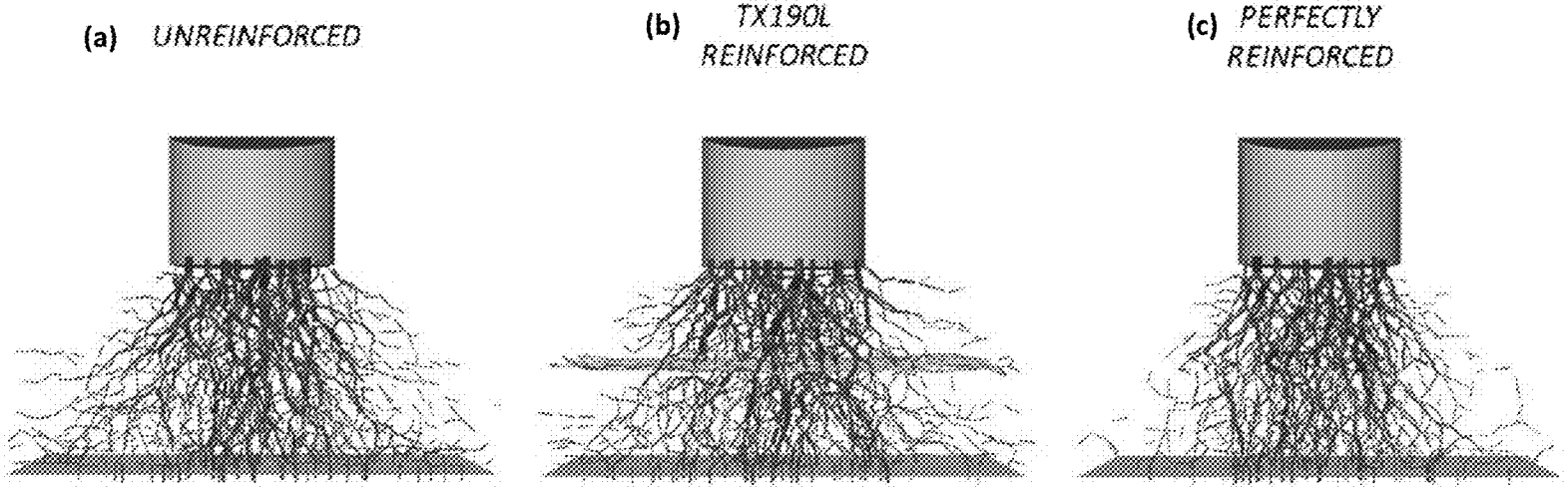
Figure 8E:
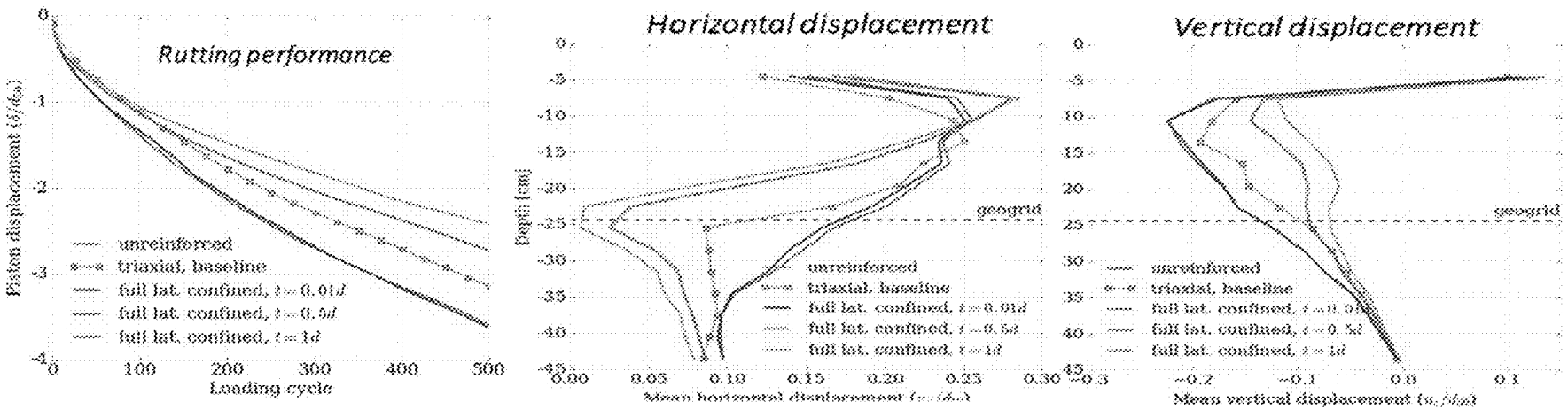

FIGS. 8D and 8E show the results of the DEM analysis. Force was applied for 100 cycles. FIG. 8D (subpanel A) shows a visualization of the piston displacement for the unreinforced (sub-panel A), reinforced (sub-panel B), and full lateral reinforced (sub-panel C). FIG. 8E shows the rutting performance (sub-panel A) for the three models of FIG. 8D, the horizontal displacement performance (sub-panel B), and the vertical displacement performance (sub-panel C).

Figure 8F:
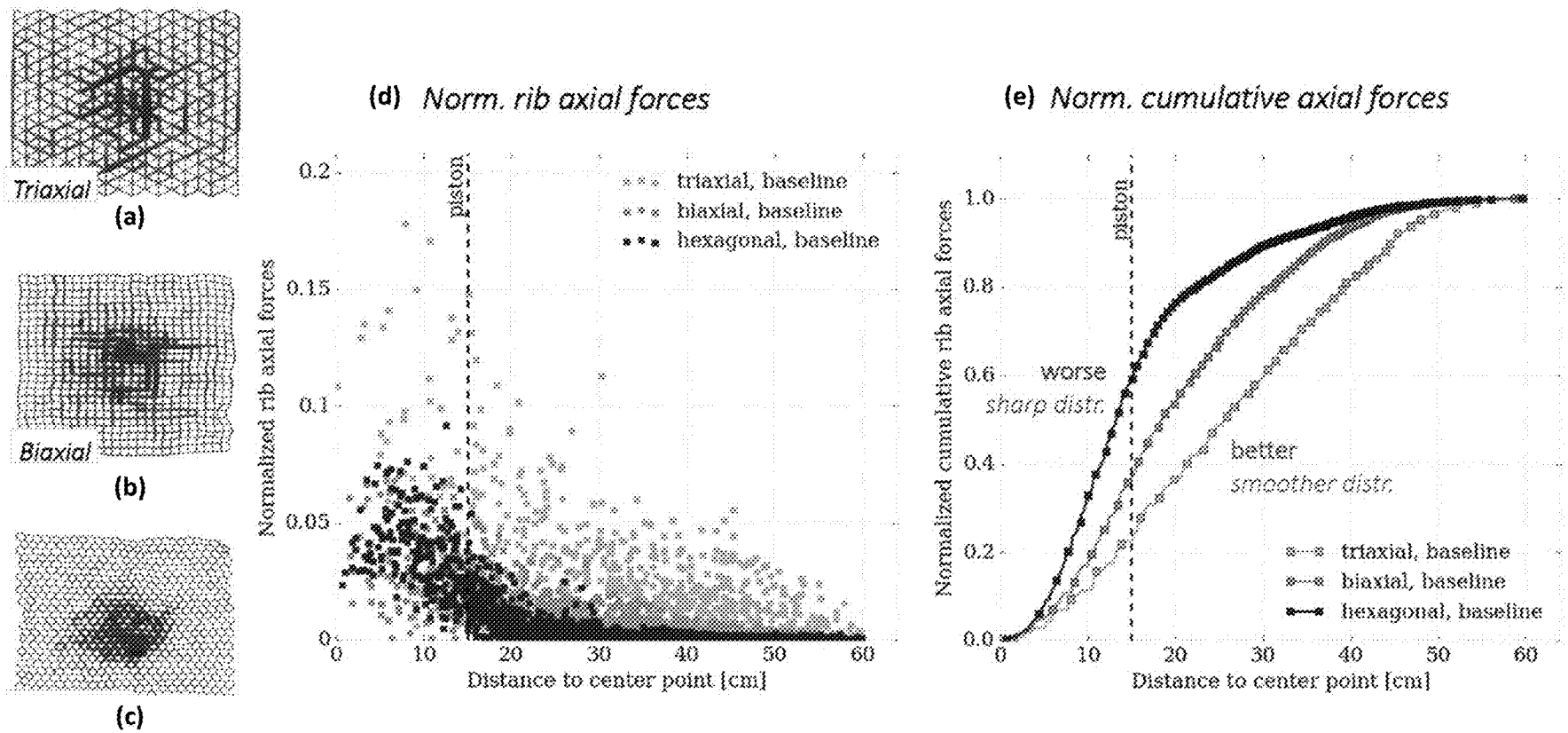

FIG. 8F shows an analysis of the force distribution to the various geogrid (triaxial, uniaxial, and hexagonal). Subpanels A, B, and C show a plot of the normalized axial force as applied the structure. Subpanel D shows a plot of the distribution of axial force from the distance of the center points. Sunpanel E shows the cumulative distribution of axial forces.

Figure 9A:
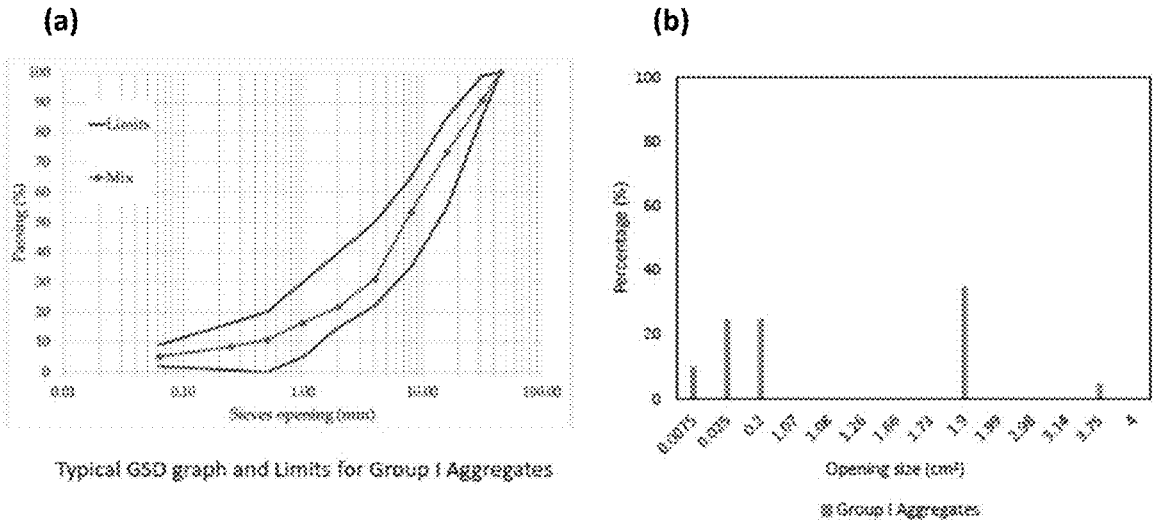
FIGS. 9A, 9B, 9C, 9D, and 9E show the spider-web inspired geogrid in having different aperture sizes in the geogrid can improve lateral containment in the geo-environment.
Figure 9B:
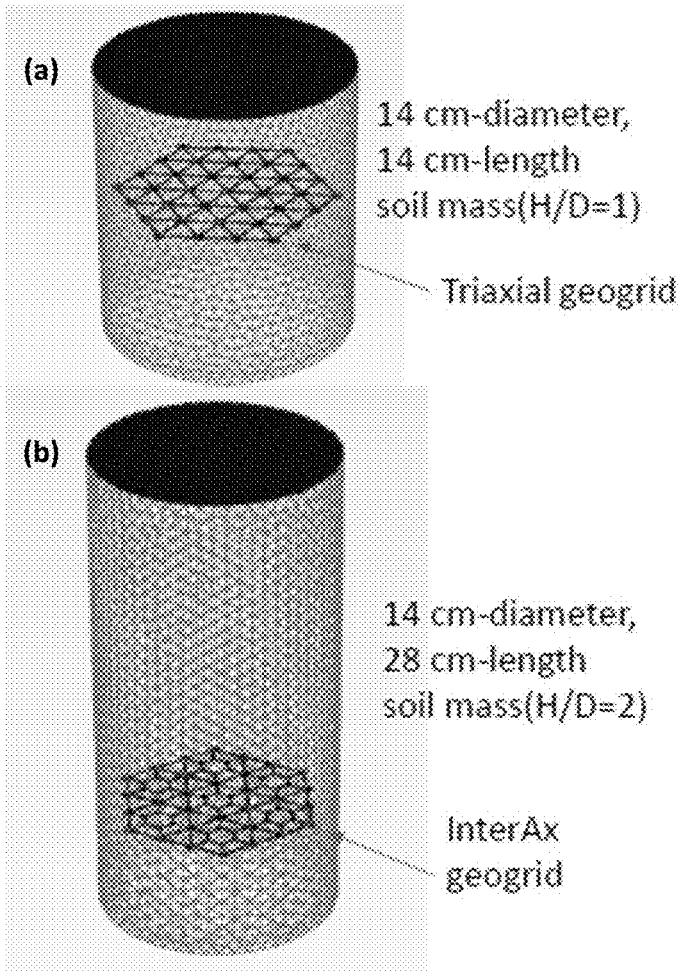
Figure 9C:
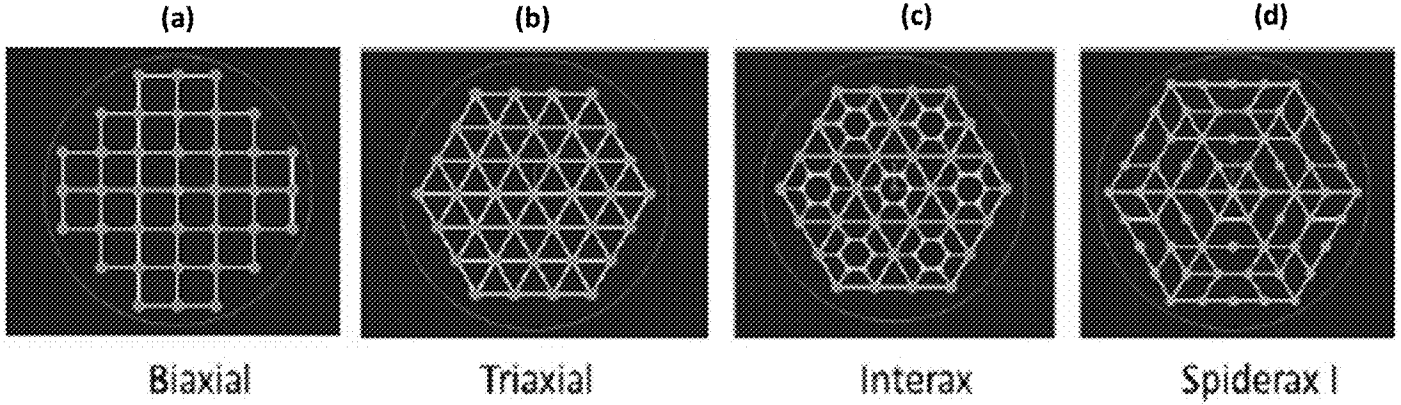
Figure 9D:
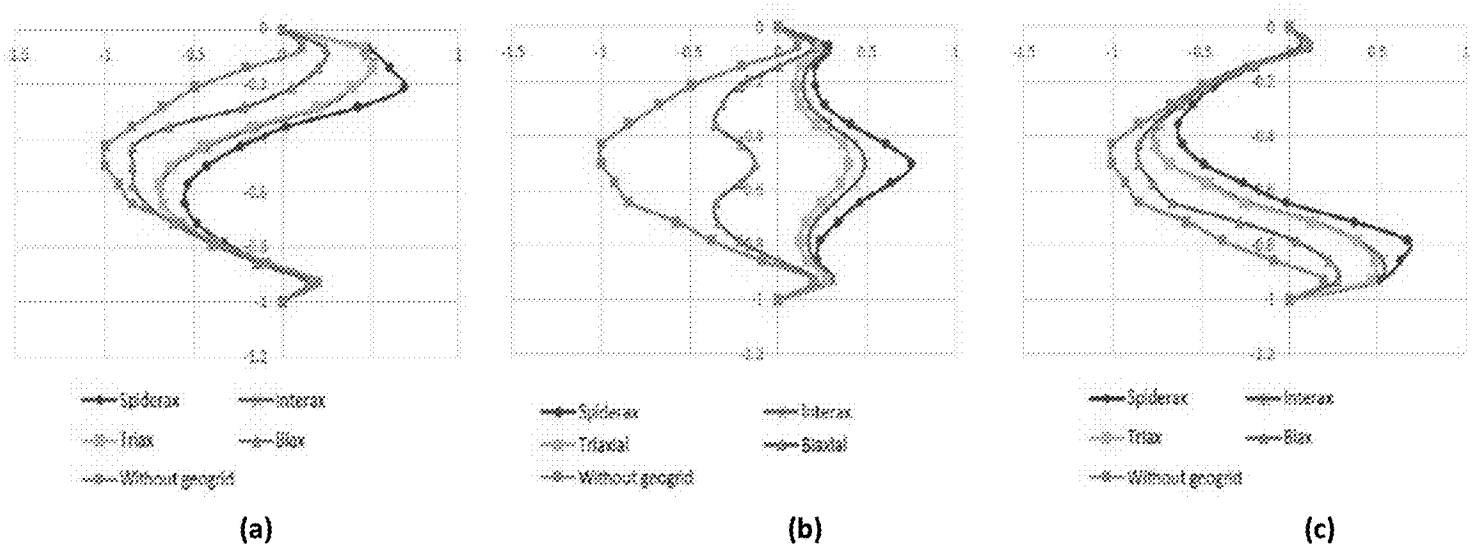

FIG. 9A shows that aggregates have gradations (subpanel B). For a certain sieve opening, a percentage of aggregates will pass (Subpanel A). FIG. 9B shows the DEM model employed in the study. FIG. 9C shows the geogrid configuration evaluated. FIG. 9D shows the results. Axial stress of 200 kPa was applied, and lateral deformation profiles (parallel to the x-axis) for the boundary (minx/left part) were drawn for cases with/without geogrids.

Figure 9E:
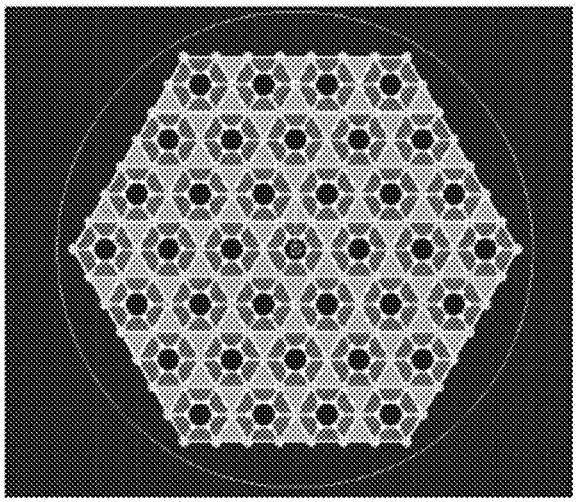
Figure 9E:
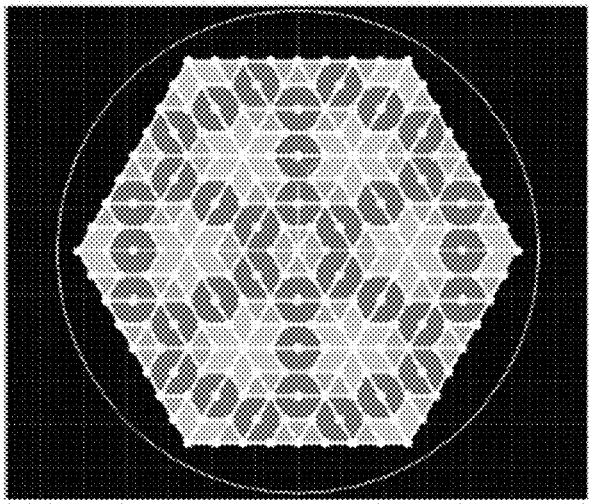
Figure 9E:
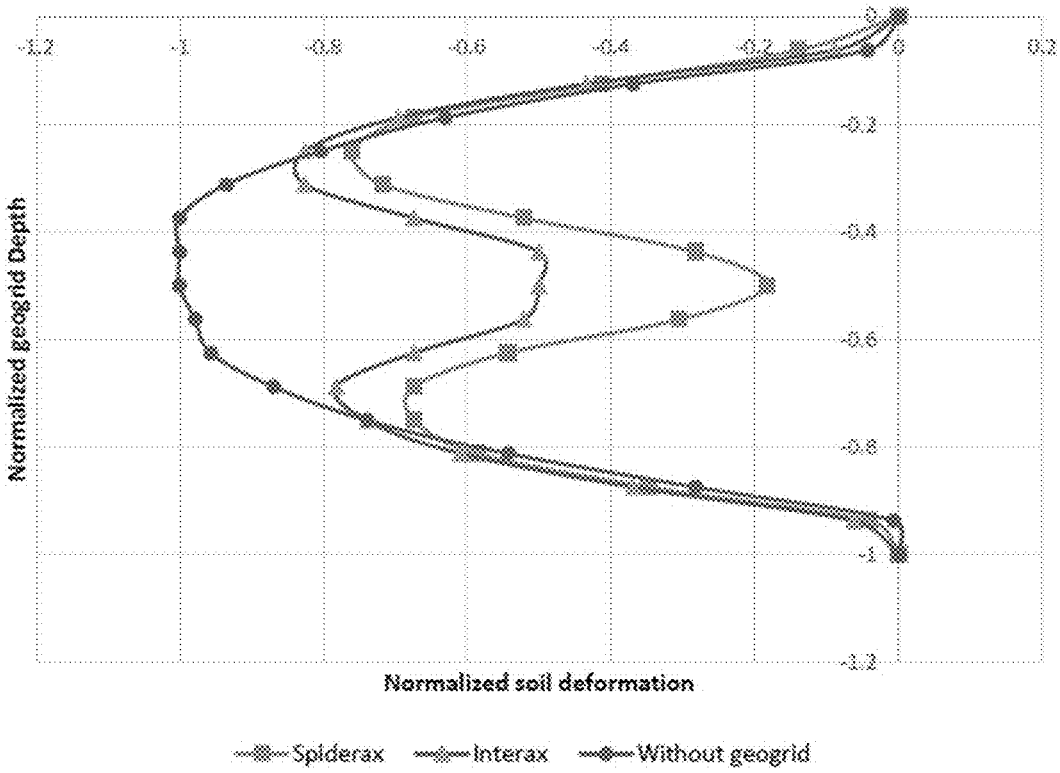

The soil deformation in the x-axis direction for different heights was recorded for all types of geogrids that were tested. In the figure below, the soil deformation after different geogrid applications is illustrated. Based on the figure below, the soil continuum is constrained more with the application of spider-web inspired geogrid compared to the commercially available geogrid geometries. FIG. 9E shows soil deformation performance between the interAx (subpanel A) and a configuration of the spider-web-inspired geogrid (subpanel B). It can be observed per subpanel-C that the spider-web-inspired geogrid has better performance in restricting the movement of aggregates.

Printable Prototypes. The study fabricated geogrid samples measuring 0.2 m (8 inches) by 0.2 m (8 inches) through 3D printing using the Original Prusa i3 3D printer. Both polypropylene (PP) filament and polylactic acid (PLA) filament were employed in manufacturing the bench-scale testing samples. FIGS. 10A-10C show the properties of each fabricated geogrid. In FIGS. 10A-10C, each geogrid was assigned a short name per Table 3. The number in the short name represents the opening size.

TABLE 3

| Label | Description |
|---|---|
| "Tr" | Traditional triaxial geogrids |
| "Y" | Y geogrids |
| "Heg" or "NegHeg" | Hexagon geogrids |
| "Tr80" | Traditional triaxial geogrids having an opening size of 0.8 inches |

Additional suffixes, such as "_t" for thicker ribs or "_w" for wider ribs, were used to denote variations from standard geogrids. "_L" signifies a larger Y structure, "_exL" denotes an extremely large Y structure, and "_small" indicates a smaller Y structure compared to normal Y geogrids. Other flags in the short name may indicate special materials; for instance, "_PLA" denotes PLA geogrids. If not specified, the geogrid is assumed to be a normal PP geogrid.

Discussion. Certain parameters in the modified spider-web-inspired geogrid can allow it to deform less compared to triaxial geogrid under the same load application. Distribution of the apertures can provide one such benefit. Many commercially available geogrids consist of only one aperture size and shape (biaxial geogrids: square, triaxial geogrid: triangle); however, typical coarse-grained soil, unless they are perfectly uniform, has a gradation. To incorporate the effect of soil gradation, it is contemplated that geogrids should also have an opening size distribution. The difference between the opening sizes of triaxial geogrid and modified spider-web-inspired geogrid is depicted in FIG. 6D, in which the same areas are shown with the same color in each geogrid.

As noted above, the ribs that are perpendicular to the edge, and therefore, in this case, perpendicular to the applied force at that edge, can be more effective in limiting the movement in the geogrid. For the other two geogrids that are tested, almost all ribs connect the outer edge to the interior part, which may be a reason for them have a maximum grid deformation compared to the modified spider-web inspired geogrid.

Discussion

It is to be understood that the methods and systems are not limited to specific synthetic methods, specific components, or particular compositions. It is also to be understood that the terminology used herein is for the purpose of describing particular implementations only and is not intended to be limiting.

As used in the specification and the appended claims, the singular forms "a," "an" and "the" include plural referents unless the context clearly dictates otherwise. Ranges may be expressed herein as from "about" one particular value, and/or to "about" another particular value. When such a range is expressed, another implementation includes from the one particular value and/or to the other particular value. Similarly, when values are expressed as approximations, by use of the antecedent "about," it will be understood that the particular value forms another implementation. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other additives, components, integers or steps. "Exemplary" means "an example of" and is not intended to convey an indication of a preferred or ideal implementation. "Such as" is not used in a restrictive sense, but for explanatory purposes.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific implementation or combination of implementations of the disclosed methods.

The following patents, applications and publications as listed below and throughout this document are hereby incorporated by reference in their entirety herein.

REFERENCE LIST

[1] Hussein, M. G. and Meguid, M. A., 2016. A three-dimensional finite element approach for modeling biaxial geogrid with application to geogrid-reinforced soils. Geotextiles and Geomembranes 44 (3) 295-307.

[2] Abdollahi, M., Moghaddas Tafreshi, S. N. and Leshchinsky, B., 2019. Experimental-numerical assessment of geogrid-EPS systems for protecting buried utilities. Geosynthetic International 26 (4) 333-353.

[3] Miao, C., Jia, Y., Zhang, J. and Zhao, J., 2020. DEM simulation of the pullout behavior of geogrid-stabilized ballast with the optimization of the coordination between aperture size and particle diameter. Construction and Building Materials 255 Article ID: 119359.

[5] Zhong, W., Liu, H., Wang, Q., Zhang, W., Li, Y., Ding, X. and Chen, L., 2021, Investigation of the penetration characteristics of snakeskin-inspired pile using DEM. Acta Geotechnica 16 1849-1865.

[6] Feng, S. J. and Wang Y. Q., 2023. DEM simulation of geogrid-aggregate interface shear behavior: Optimization of the aperture ratio considering the initial interlocking states. Computers and Geotechnics 154 Article ID: 105182.

[7] Ahlvin, R. G. and H. H. Ulery (1962). Tabulated values for determining the complete pattern of stresses, strains, and deflections beneath a uniform circular load on a homogeneous half space. 41st Annual Meeting of the Highway Research Board. Washington, DC.

[8] Bendsøe, M. P. and O. Sigmund (2004). Topology Optimization, Springer Berlin, Heidelberg.

[9] Eschenauer, H. A. and N. Olhoff (2001). "Topology optimization of continuum structures: A review." Applied Mechanics Reviews 54(4):331-390.

[10] Kennedy, G. J. (2021). "AE6170 Structural Optimization Course Notes." from https://github.gatech.edu/pages/gkennedy9/ae6170_book/.

[11] PLAXIS (2023). PLAXIS 3D Material Models Manual, PLAXIS B.V.: Delft, The Netherlands.

[12] Stolpe, M. and K. Svanberg (2001). "An alternative interpolation scheme for minimum compliance topology optimization." Structural and Multidisciplinary Optimization 22(2): 116-124.

What is claimed:

1. A geogrid comprising:

a substantially planar layer of polymeric material having a pattern formed therein to provide lateral confinement of a geotechnical environment to restrict displacement of aggregates, wherein the pattern comprises a plurality of interlocking beam members to form a repeating set of polygonal unit cells, wherein each cell of the repeating set of polygonal unit cells comprises (i) a center and (ii) a plurality of repeating apertures formed in between the interlocking beam members, wherein the plurality of repeating apertures of each unit cell comprises a first region comprising a first set of apertures having at least three vertices and a second region disposed radially outward from the first region relative to the center, the second region comprising a second set of apertures having (i) at least four vertices selected from the group consisting of a square-, rectangular-, parallelogram-, deltoid-, and trapezoidal-shaped apertures or (ii) a triangular-shaped apertures each having an different orientation to one another, wherein each of the repeating set of polygonal unit cells has a center interconnection at the center to which a plurality of continuous rib members and associated apertures extend and connect to lateral members, defining one or more radial transect boundaries that extend circumferentially around the center to at least partially define the first and second regions of the plurality of repeating apertures, wherein the plurality of continuous rib members extend radially through the center, and through the one or more radial transect boundaries, to an outer boundary of the repeating polygonal unit cell.

2. The geogrid of claim 1, wherein the plurality of apertures of each of the repeating set of polygonal unit cells have multiple predefined opening size distributions, including a first opening size, a second opening size, and a third opening size, wherein the first opening size has a first percentage distribution, the second opening size has a second percentage distribution, the third opening size has a third percentage distribution.

3. The geogrid of claim 2, wherein the predefined opening size distributions of the plurality of apertures is optimized based at least in part on structural and energy analysis, wherein the geogrid has improved stiffness to retain aggregate in place by minimizing calculated strain energy.

4. The geogrid of claim 1, wherein the plurality of repeating apertures has a range of primary axis orientations.

5. The geogrid of claim 1, wherein the center interconnection includes at least six continuous ribs that extends from the center of the repeating set of polygonal unit cell for a polygonal unit cell having at least 6 sides.

6. The geogrid of claim 1, wherein the center interconnection includes a pre-defined number of continuous ribs that extends from the center of the repeating set of polygonal unit cell, wherein the pre-defined number of continuous ribs is equal to, or is a multiple of, a number of sides of the boundary of a repeating polygonal unit cell.

7. The geogrid of claim 6, wherein the pre-defined number of continuous ribs is twice or thrice that of a number of sides of the boundary of a repeating polygonal unit cell.

8. The geogrid of claim 1, wherein each of the continuous rib members of the center interconnection extend to a corner of the boundary of a repeating polygonal unit cell.

9. The geogrid of claim 1, wherein the repeating set of polygonal unit cells having the plurality of repeating apertures are aligned adjacent to one another to form a secondary structure form.

10. The geogrid of claim 1, wherein the repeating set of polygonal unit cells having the plurality of repeating apertures has a primary axis orientation for the apertures that are aligned adjacent to one another to form a secondary structure form.

11. The geogrid of claim 1, wherein the pattern of the plurality of interlocking beam members has beam members extending from the radial transect boundaries to sides of the boundary of a repeating polygonal unit cell.

12. The geogrid of claim 1, wherein the geogrid is employed as a retaining structure used to separate different elevations of aggregate material.

13. The geogrid of claim 12, wherein the aggregate structure comprises a pavement system.

14. The geogrid of claim 12, wherein the aggregate structure comprises a building foundation system.

15. The geogrid of claim 1, wherein the center interconnection includes a first continuous rib, a second continuous rib, and a third continuous rib that each extends from the center of the repeating set of polygonal unit cell, wherein the pattern includes a set of continuous ribs that are parallel of each of the first continuous rib, the second continuous rib, and the third continuous rib to define a set of triangular secondary structures, and wherein each of the set of triangular secondary structures are bisected by tertiary rib structures.

16. The geogrid of claim 1, wherein the center interconnection includes a first continuous rib, a second continuous rib, and a third continuous rib that each extends from the center of the repeating set of polygonal unit cell, the center interconnection including a plurality of radial transect boundaries to define a plurality of radial apertures within the center interconnection.

17. The geogrid of claim 16, wherein the pattern include a portion of the center interconnection repeated at regions between the plurality of radial transect boundaries and the boundary of a repeating polygonal unit cell.

18. The geogrid of claim 1, wherein the center interconnection includes a first continuous rib, a second continuous rib, and a third continuous rib that each extends from the center of the repeating set of polygonal unit cell, wherein the pattern includes a set of ribs forming the radial transect boundaries having a first shape, wherein boundary sides of a repeating polygonal unit cell has a second shape, wherein the first shape and the second shape are the same, wherein the first shape is rotated 30 degrees from the second shape.

19. The geogrid of claim 1, wherein the repeating polygonal unit cell comprises a plurality of radial transect boundaries each radially spaced apart from each other and each extending circumferentially around the center.

* * * * *